US006491252B2

(12) United States Patent
Komatsu et al.

(10) Patent No.: US 6,491,252 B2
(45) Date of Patent: Dec. 10, 2002

(54) WINDING CORE HOLDING MECHANISM, ROLL MEDIUM HOLDING DEVICE HAVING THE SAME, AND WINDING DEVICE USING SAID MECHANISM AND DEVICE

(75) Inventors: Fumito Komatsu, Nagano (JP); Noboru Ueno, Nagano (JP); Kiyotsugu Takasawa, Nagano (JP)

(73) Assignees: Sankyo Seiki Mfg, Co., Ltd., Nagano (JP); Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/828,006

(22) Filed: Apr. 6, 2001

(65) Prior Publication Data

US 2001/0054667 A1 Dec. 27, 2001

(30) Foreign Application Priority Data

Apr. 7, 2000 (JP) ..... 2000-107191
Apr. 7, 2000 (JP) ..... 2000-107199

(51) Int. Cl.[7] ..... B65H 16/06; B65H 18/04

(52) U.S. Cl. ..... 242/596.1; 242/596.4; 242/596.7

(58) Field of Search ..... 242/596.1, 596.4, 242/596.7

(56) References Cited

U.S. PATENT DOCUMENTS 1,119,179 A * 12/1914 Krauth ..... 242/596.4
1,811,779 A * 6/1931 Caps ..... 242/596.1
2,214,097 A * 9/1940 Anderson ..... 242/596.1
2,905,404 A * 9/1959 Simmons ..... 242/596.4
3,326,487 A * 6/1967 Huck ..... 242/596.1
4,915,319 A * 4/1990 Gerber ..... 242/596.4
5,662,288 A * 9/1997 Chiang ..... 242/596.1

* cited by examiner

*Primary Examiner*—John M. Jillions
(74) *Attorney, Agent, or Firm*—Reed Smith LLP

(57) ABSTRACT

A winding core holding mechanism is described for holding at least one end portion of a winding core on which a thin medium such as paper, film, or cloth is wound. The mechanism comprises a base fixed in the axial direction of the winding core. A larger diameter reference portion is included, which is capable of axially moving in and out of the base and abuts an end face of the winding core. The mechanism also comprises a tapered larger diameter centering portion which is capable of axially moving in and out of the larger diameter reference portion and fits into the winding core of larger diameter. Also included is a smaller diameter reference portion, which is capable of axially moving in and out of the base and abuts an end face of the winding core of smaller diameter. A tapered smaller diameter centering portion is further included, which is capable of axially moving in and out of the smaller diameter reference portion and fits into the winding core of smaller diameter. In order to hold the winding core of larger diameter, the larger diameter centering portion centers the winding core while falling into the larger diameter reference portion, and also the larger diameter reference portion falls into the base to position the end face at a predetermined reference position with respect to the base. In order to hold the winding core of smaller diameter, the smaller diameter centering portion centers the winding core while falling into the smaller diameter reference portion, and also the smaller diameter reference portion, the larger diameter reference portion, and the larger diameter centering portion fall into the base to position the end face at the reference position.

5 Claims, 29 Drawing Sheets

WINDING CORE HOLDING MECHANISM, ROLL MEDIUM HOLDING DEVICE HAVING THE SAME, AND WINDING DEVICE USING SAID MECHANISM AND DEVICE

BACKGROUND OF THE INVENTION

1. Field of the Invention

The present invention relates to a winding core holding mechanism for supporting a winding core on which a thin medium such as paper, film or cloth is wound in a roll, relates to a roll medium holding device having the winding core holding mechanism, and relates to a winding device using those. More specifically, the present invention relates to a winding core holding mechanism suitable for supporting a winding core on which a roll paper output by a large-scale printer is wound, and a winding device using this. Also, the present invention relates to a roll medium holding device suitable for holding a roll paper output by a large-scale printer, and a winding device using this.

2. Description of the Related Art

Normally used as drawing media for large-scale full color printers (of ink jet or electrostatic recording types) are papers, films, or cloths wound on a pipe-like paper tube made of cardboard. One of the means for storing a printed medium is to wind a printed medium 100 on a paper tube 102 by a winding device 101 to store the medium 100 in a roll, as illustrated in FIGS. 26 and 27.

In a device for supplying the medium 100 to a printer 104 (not illustrated) or in the winding device 101, the roll medium 100 is held such that the paper tube 102, on which the medium 100 is wound, is sandwiched by winding core holding members 103 from both sides. Also, the paper tube 102 to be installed in the winding device 101 is the same kind as the paper tube 102 of the medium used in the supply side.

There are two kinds of paper tubes that are normally used according to the hardness and winding characteristics of the medium 100: of 2-inch or 3-inch diameter. In order to hold two kinds of paper tubes 102 in a single winding device 101, the 2-inch core holding member and the 3-inch core holding member are interchangeably used through attachment/detachment thereof. Otherwise, as illustrated in FIG. 28, a 2-inch core holding portion 115 is formed on one side of the winding core holding member 103 and a 3-inch core holding portion 106 is formed on the other.

Since the paper tube 102 is made of cardboard, the inner diameter of the paper tube 102 varies by about 2.5 mm. For example, the inner diameter of a $\phi 2$ inch paper tube may vary within the range 450 mm to +52.5 mm. For this reason, a holding portion 103*a* of the winding core holding member 103 is made in a conical shape to hold the paper tube 102 with the tapered surface so that the paper tube is centered and held even if the inner diameter of the tube 102 is not uniform.

Furthermore, the medium 100 is output in sizes of B0, A0 through A2, for example. Therefore, roll media of various widths are on the market to meet these size requirements. To meet with media 100 of different widths, one of the winding core holding members 103 may be configured capable of sliding with respect to a stay in the axial direction of the paper tube 102, i.e., in the width direction W of the medium 100, as illustrated in FIG. 30.

To hold the paper tube 102 using the above, the winding core holding member 103 is slid in the width direction W according to the width of the medium 100 to sandwich the paper tube 102. A knob 105 is turned to secure the winding core holding member to the stay 106 so that the winding core holding member 103 will not become loose and the paper tube 102 will not come off. Although the winding core holding member 103 is secured by a screw in this example, a pin may be used as a position fixing means to secure the winding core holding member 103 to the stay 106.

However, using this winding core holding member 103, the components need to be changed according to the diameter of the paper tube 102 as illustrated in FIG. 28. This results in poor operability due to complicated attaching and detaching operations. Also, a cap, fixture, etc. may be lost during the operation of the attaching/detaching of the components. Moreover, because the winding core holding member 103 uses two different components depending on the size of the paper tube 102, one of the components which is not in use may be lost while the other component is in use.

Furthermore, since the winding core holding member 103 supports the non-uniform inner diameter of the paper tube 102 with the tapered surface of the holding portion 103*a*, the position on the tapered surface to stop the paper tube 102 varies depending on the size of the inner diameter of the tube 102. Therefore, although the paper tube 102 is centered, the end face 102*a* thereof in the width direction W cannot be constantly positioned at the same position in the width direction W. For this reason, the center of the winding position of the paper tube 102 is shifted from the center of the winding core of the medium 100 output by the printer 104. If the front end of the medium 100 is set and attached along the width of the paper tube 102 and winding is started under this condition, the medium 100 easily wanders off, making a winding-up difficult. In view of this, a paper tube 102 slightly longer than the width of the medium 100 needs to be used. With this, however, a winding core which is exclusively used for the winding purpose should be used for every medium of different width. This results in complicated storing and managing of the cores. Also, the paper tube 102 that was used in the supply side cannot be recycled. Moreover, the paper tube 102 has ends which stick out of the edges of the roll medium after winding-up.

In addition, when the winding core holding member 103 is positioned and fixed by a rotation of the knob 105 or by a pin, two different sliding and locking/unlocking operations are required for moving/locking or unlocking/moving the winding core holding member 103. This results in poor operability. Particularly, to move the winding core holding member 103 to detach the medium 100 after winding, the heavy wound-up roll medium 100 is handled with a single hand. Thus, he operation becomes troublesome.

If a winding core is used exclusively for a winding purpose, instead of using the recycled paper tube 102, the winding core may be easily attached/detached to the winding device 101 or to the printer 104. With this, however, a winding core needs to be prepared for every medium of different width. This results in complicated storing and maintaining of the components, and also the paper tube 102 that is no longer needed in the supply side will be wasted.

OBJECT AND SUMMARY OF THE INVENTION

Then, a primary object of the present invention is to provide a winding core holding mechanism which can hold two kinds of winding cores of different sizes without changing components and can position both kinds of winding cores at a predetermined reference position, and a winding device using the core holding mechanism.

Another object of the present invention is to provide a roll medium holding device which can easily attach/detach a winding core such as a paper tube, and a winding device using the roll medium holding device.

To achieve the above objects, the present invention provides a winding core holding mechanism for holding at least one of the end portions of a winding core on which a thin medium such as paper, film, or cloth is wound, comprising a base fixed in the axial direction of the winding core, a larger diameter reference portion, which is capable of axially moving in and out of the base and which abuts to an end face of the winding core, a tapered larger diameter centering portion, which is capable of axially moving in and out of the larger diameter reference portion and which fits into the winding core of larger diameter, a smaller diameter reference portion, which is capable of axially moving in and out of the base and which abuts to an end face of the winding core of smaller diameter, and a tapered smaller diameter centering portion, which is capable of axially moving in and out of the smaller diameter reference portion and which fits into the winding core of smaller diameter. With this invention, to hold the winding core of larger diameter, the larger diameter centering portion centers the winding core while falling into the larger diameter reference portion, and the larger diameter reference portion falls into the base to position the end face at a predetermined reference position with respect to the base; to hold the winding core of smaller diameter, the smaller diameter centering portion centers the winding core while falling into smaller diameter reference portion, and the smaller diameter reference portion, the larger diameter reference portion, and the larger diameter centering portion fall into the base to position the end face at the reference position.

Thus, the winding core of larger diameter is centered by the larger diameter centering portion and is positioned at the reference position by the larger diameter reference portion. The winding core of smaller diameter is centered by the smaller diameter centering portion and is positioned at the reference position by the smaller diameter reference portion. The winding cores of both larger diameter and smaller diameter can be held in this manner without changing the components. This improves operability and eliminates a complicated management of the components.

Also, the reference position for the winding core can be always at the same position regardless of the size of the attached winding core. Therefore, when the winding core holding mechanism is used in a printer or a winding device, the position of the medium output by the printer is easily aligned with the position of the winding core. This prevents the medium from an oblique winding.

Further, each reference portion supports the winding core by the end face, and each centering portion centers the core with the tapered surface thereof. Therefore, even if the inner diameter of the winding core is not uniform, the center of rotation is first centered, and then the winding core end face is always set at the reference position.

The invention further provides a winding device for winding a thin medium such as paper, film, or cloth output by a printer on a winding core, comprising the winding core holding mechanism as described above to hold the winding core.

Therefore, the reference edges of the medium supplied by the printer can be easily aligned with the reference position on the winding side. This prevents the medium from an oblique winding.

To achieve the above objects, the invention also provides a roll medium holding device that has a winding core holding mechanism for holding one end of a winding core of a thin medium such as paper, film, or cloth wound in a roll, a slider portion fixed to the winding core holding mechanism, and a guiding portion for supporting the slider portion to be capable of sliding along the width direction of the medium, comprising a locking means that locks the slider portion from sliding in the direction away from the winding core, and an unlocking means that unlocks the locking means.

To attach the winding core, the slider portion is pushed and slid toward the winding core. As the winding core holding mechanism abuts to the winding core and holds it, the pressing effect on the slider portion is stopped. At that time, the slider portion will not move away from the winding core due to the effect of the locking means; thus, the holding condition of the winding core is maintained. With this, the winding core can be attached by a one-touch operation.

To remove the winding core, the unlocking means is operated to slide the slider portion and the winding core holding mechanism. Thus, the winding core can be removed by an easy operation almost like the one-touch operation.

The invention further provides the roll medium holding device as set forth above, wherein the locking means has wedge-shaped facing planes formed between the slider portion and the guiding portions and a stopper member for locking relative movement between the slider portion and the guiding portions.

Thus, the locking means can be composed of a simple mechanism. Accordingly the cost of the roll medium holding device can be reduced.

The invention still further provides the roll medium holding device as set forth above wherein the operational direction of the unlocking means agrees with the receding direction of the slider portion. Therefore, the operation of the unlocking means and the receding operation of the slider portion can be performed by a one-touch operation. This improves operability.

The invention additionally provides a winding device that winds a thin medium such as paper, film, or cloth output by a printer, comprising the roll medium holding device as described above. With this, the operability is improved for installing an empty winding core in the winding device and for removing the wound-up roll medium from the winding device.

BRIEF DESCRIPTION OF THE INVENTON

DESCRIPTION OF THE PREFERRED EMBODIMENTS

Figure 1:
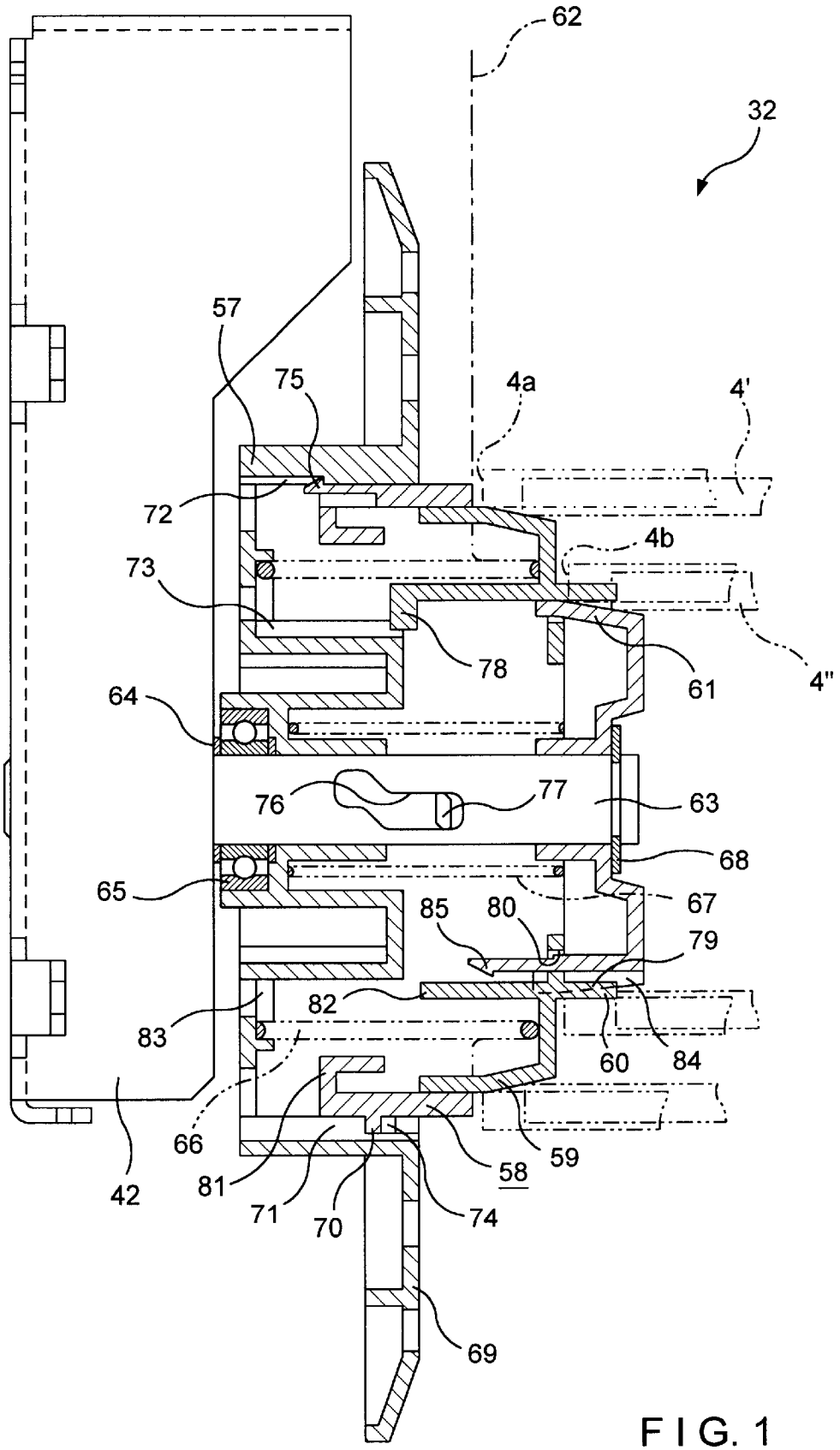
FIG. 1 is a plan view of a center cross-sectional view of a core holding mechanism of the present invention.

The configuration of the present invention is described in detail based on an embodiment illustrated in the drawings. FIGS. 1 through 25 illustrate an embodiment in which a winding device 1 having winding core holding mechanisms 8 and 32 and a roll medium holding device 33 of the present invention is used in a printer 2. The printer 2 is a large-scale full color printer 2 of ink jet type or electrostatic recording type, and a drawing medium 3 thereof is, for example, a roll paper wound on a pipe-like paper tube made of cardboard as the winding core 4.

As illustrated in FIGS. 1 through 4, at least one of the winding core holding mechanisms 8, 32, which hold the winding core 4 from the right and left sides, has a base 57, a larger diameter reference portion 58, a tapered larger diameter centering portion 59, a smaller diameter reference portion 60, and a tapered smaller diameter centering portion 61. The base 57 is fixed in the axial direction of the winding core 4. The larger diameter reference portion 58 is capable of axially moving in and out of the base 57 and makes contact with an end face 4*a* of a winding core 4' of larger diameter. The centering portion 59 is capable of axially moving in and out of the larger diameter reference portion 58 and fits to the core 4' of larger diameter. The smaller diameter reference portion 60 is capable of axially moving in and out of the base 57 and makes contact with an end face 4*b* of a winding core 4" of smaller diameter. The smaller diameter centering portion 61 is capable of axially moving in and out of the smaller diameter reference portion 60 and fits to the core 4" of smaller diameter.

To hold the larger diameter core 4', the larger diameter centering portion 59 centers the core 4' as falling into the larger diameter reference portion 58 which in turn falls into the base 57. The end face 4*a* of the larger diameter core 4' is positioned at a predetermined reference position 62 with respect to the base 57. To hold the smaller diameter core 4', the smaller diameter centering portion 61 centers the core 4' as falling into the smaller diameter reference portion 60. Then, the smaller diameter reference portion 60, larger diameter reference portion 58, and larger diameter centering portion 59 fall into the base 57, to position the end face 4*b* of the smaller diameter core 4' at the reference position 62.

For this reason, both the larger diameter core 4' of 3 inches of inner diameter and the smaller diameter core 4' of 2 inches of inner diameter can be held. Thus, two kinds of winding cores 4' and 4" can be supported without changing components. This improves operability and eliminates a complicated management of components. Also, the reference position 62 for the core 4 can be determined regardless of the size of the mounted core 4. Therefore, when the core holding mechanism is used in the winding device 1 or in the printer 2, the reference edge 31 of the medium 3 output from the printer 2 can be easily aligned with the reference position 62 of the winding core 4. Consequently the oblique winding of the medium 3, which is normally caused due to disagreement between the reference edge 31 and reference position 62, can be prevented. Further, each reference portion 58, 60 supports the winding core 4 by the end face 4*a* , 4*b* , and each centering portion 59, 61 centers the winding core 4 with the tapered surface. Therefore, even when the inner diameter of the winding core 4 is not uniform, the center of rotation is first centered, and then the end faces 4*a* and 4*b* of the core 4 can be always positioned at the reference position.

Figure 6:
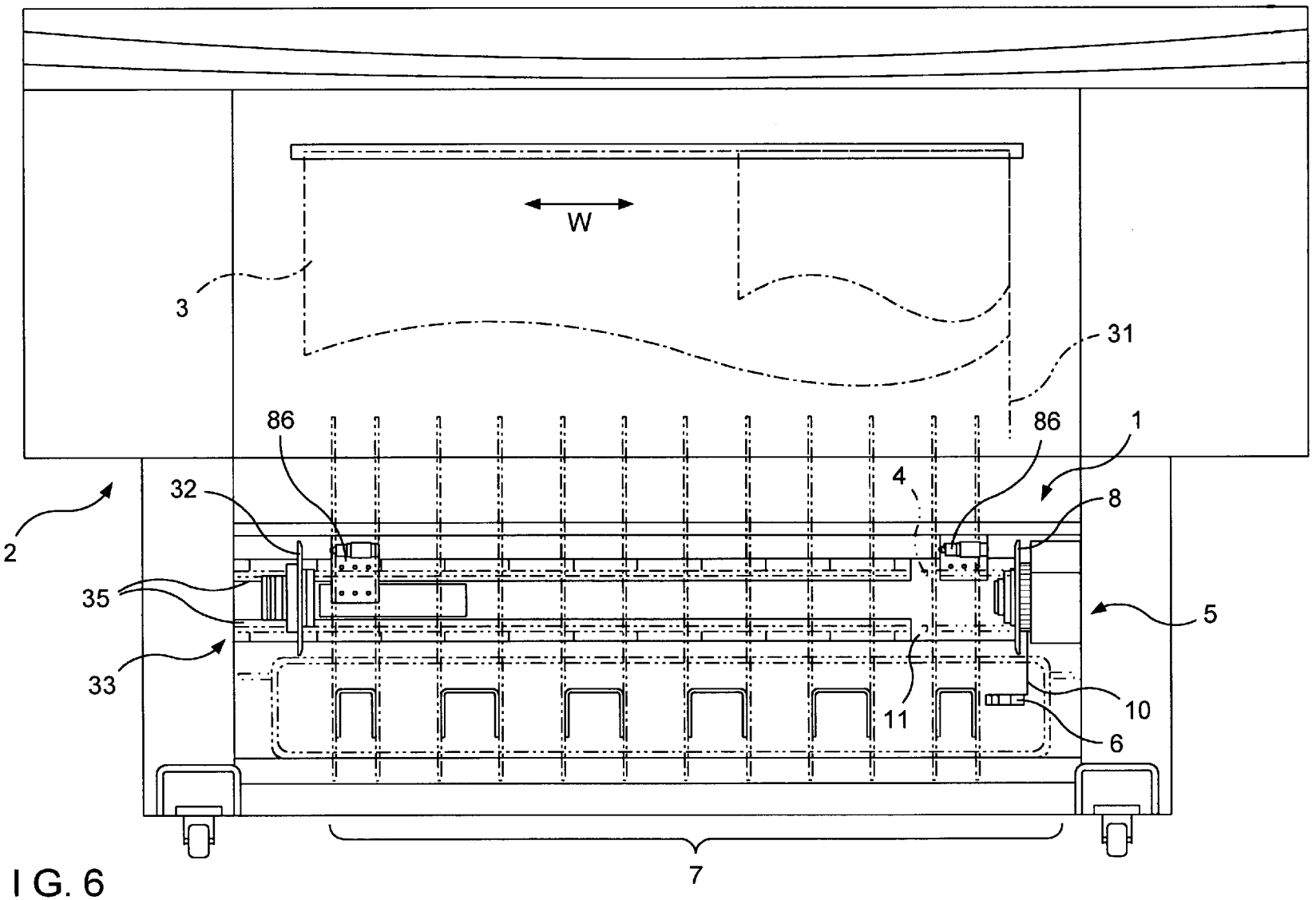
FIG. 6 is a front view of the entire printer in which the winding device is used.

In the printer 2 of this embodiment, a right side edge 31 of the output medium 3 in FIG. 6 is used as a reference edge 31. The end of the winding core 4, which is held by the winding core holding mechanism of the winding device 1 on the right side (hereinafter denoted as a fixed-side winding core holding mechanism), is aligned with the reference edge 31. On the other hand, the core holding mechanism 32 on the left side in FIG. 6 (hereinafter denoted as a sliding-side core holding mechanism) is supported capable of sliding by a roll medium holding device 33. The sliding-side core holding mechanism 32 is slid for attaching/detaching the winding core 4.

Figure 29:
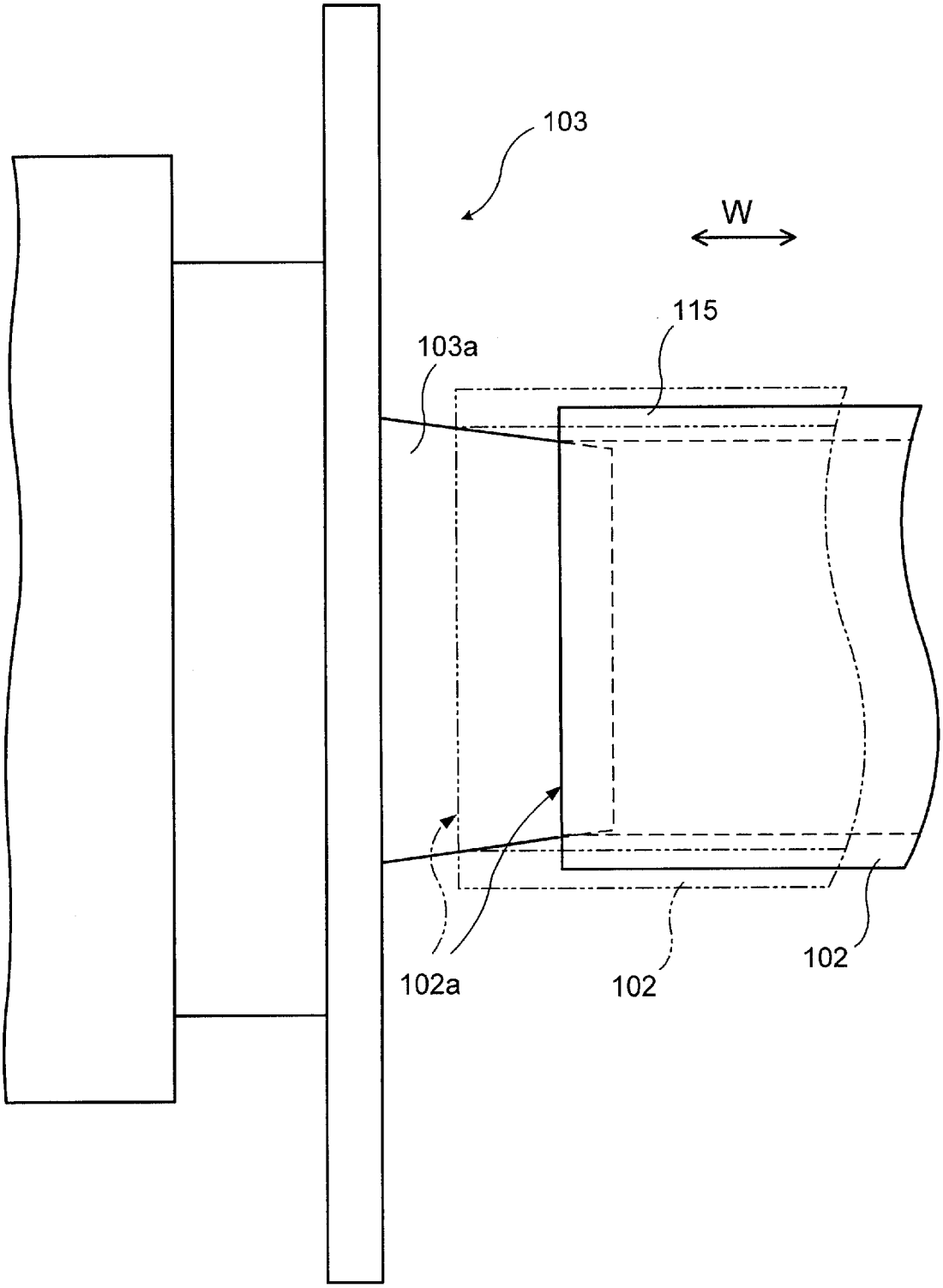
F I G. 29 PRIOR ART
FIG. 29 is a side view of another conventional winding core holding member.
Figure 30:
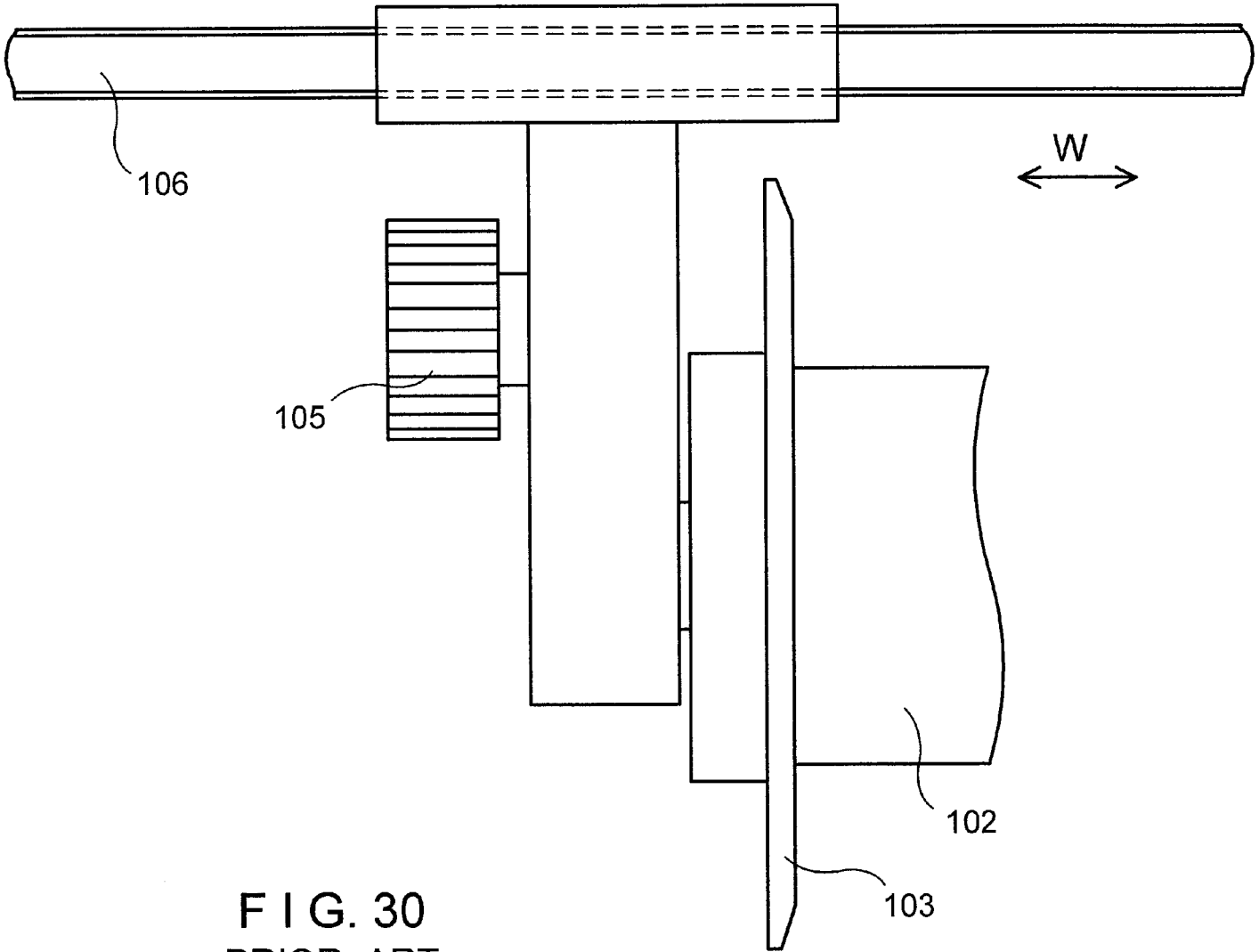
FIG. 30 PRIOR ART
FIG. 30 is a front view of a position fixing means of the conventional winding core holding member.

In this embodiment, the winding core holding mechanisms 8 and 32 on left and right are configured the same except that the gear portion 15 is provided only in the core holding mechanism 8 and bearing 65 and washer 64 are provided only in the core holding mechanism 32. As a result, the core holding mechanisms 8 and 32 on the left and right sides share most of the components, and thus the cost of the components can be reduced. Although both the core holding mechanisms 8 and 32 on the left and right sides are used to determine the reference position 62 in this embodiment, if at least fixed-side winding core holding mechanism 8 can determine the reference position 62, the position 62 can be aligned with the reference edge 31 of the medium 3. In this case, the sliding-side winding core holding mechanism 32 is simply configured to have a tapered centering portion as illustrated in FIG. 29, for example. This simplifies the configuration of the sliding-side core holding mechanism 32.

Each of the core holding mechanisms 8 and 32 of this embodiment further has a flange shaft 63 fixed to the supporting stay 42 or spool supporting plate 12. The flange shaft 63 passes through the washer 64, bearing 65, base 57, larger diameter reference portion 58, larger spring 66, smaller spring 67, larger diameter centering portion 59, smaller diameter reference portion 60, and smaller diameter centering portion 61 in this order; the smaller diameter centering portion 61 is stopped from coming off by E-ring 68. The members other than the washer 64 and an inner ring of the bearing 65 rotate together with the core 4 held thereby. Since the bearing 65 is used in each of the core holding mechanisms 8 and 32, the rotation load on the members rotating together with the core 4 is reduced, and the core 4 held by those members is prevented from idle rotation.

The base 57 is formed with a flange 69 for protecting the side edges of the medium 3. The base 57 also has protrusion raising portions 70, axially extending escape grooves 71 cut adjacent to the protrusion raising portions 70, recess portions 72, and axially parallel guide grooves 73. The larger diameter reference portion 58 includes protrusions 74, which hit against the protrusion raising portions 70 of the base 57 or are guided to the escape grooves 71, nails 75 to be caught at the recess portions 72 of the base 57, and cam grooves 76. Although the larger diameter reference portion 58 is capable of sliding with respect to the base 57, the nails 75 on the larger diameter reference portion 58 are caught by the recess portions 72 of the base 57 to prevent the reference portion 58 from coming off from the base 57. The amount of the sliding of the larger diameter reference portion 58 in the direction to fall into the base 57 varies depending on the rotational angle of the larger diameter reference portion 58 with respect to the base 57. In other words, when the protrusions 74 on the larger diameter reference portion 58 contact the protrusion raising portions 70, the reference portion 58 can fall into the base no farther than that. On the other hand, when the larger diameter reference portion 58 is rotated and the protrusions 74 are guided to the escape grooves 71 of the base 57, the reference portion can further fall into the base. Note that, as understood in FIG. 19, the protrusion raising portion 70, escape groove 71, recess portion 72, guide groove 73, protrusion 74, pawl(nail) 75, cam groove 76, cam protrusion 77, sliding protrusion 78, and bottom portion 83 are respectively formed at three positions, i.e., equally positioned by 120° around the corresponding circumferences in this embodiment. It is not limited to this.

Figure 3:
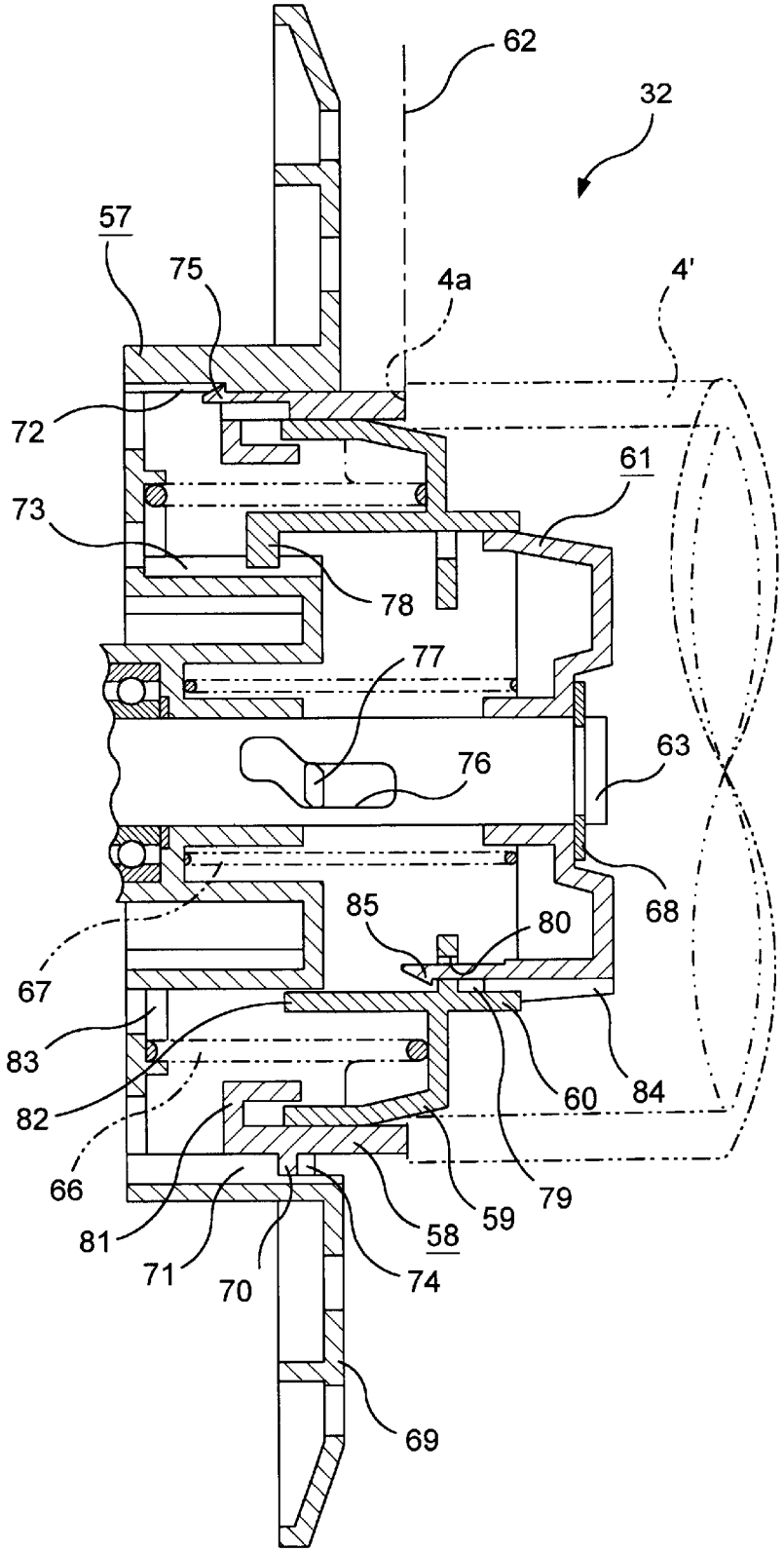
FIG. 3 is a plan view of a center cross-sectional view of the core holding mechanism holding a winding core of larger diameter.

The protrusion raising portions 70 and protrusions 74 are positioned such that when the winding core 4' of larger diameter is made to contact with and pushed into the larger diameter reference portion 58, the end face 4*a* of the core 4' is positioned a predetermined distance (7 mm, for example) away from the inner surface of the flange 69, as illustrated in FIG. 3. Consequently the flange 69 is separated from the winding core 4' by a predetermined distance, and the end face 4*a* of the core 4' can be positioned at the reference position 62. Further, because the flange 69 and core 4' are positioned with a predetermined distance from one another, the gap can be a relief for various situations such as the case that the medium 3 reference edge 31 and the reference position 62 are shifted from one another, the case that the medium 3 absorbs moisture during printing and the width dimension thereof expands, the case that there is a discrepancy between the length of the winding core on the supply side and that on the winding side although the normal dimensions are the same, and the case that there is a discrepancy between the length of the winding core on the supply side and the width of the medium 3. This provides a countermeasure to the cause that hinders winding. In this embodiment, although the distance between the flange 69 and winding core 4' is set 7 mm, it is not limited to this.

The smaller diameter reference portion 60 is formed integrally with the larger diameter centering portion 59. The smaller diameter reference portion 60 includes cam protrusions 77, slide protrusions 78, axially parallel guiding grooves 79, and engaging holes 80. The cam protrusions 77 are guided to the cam grooves 76 cut in the larger diameter reference portion 58, and the slide protrusions 78 are guided to the guiding grooves 73 cut in the base 57. With this configuration, the smaller diameter reference portion 60 is rotated by the cam mechanism 76 and 77 while sliding into the larger diameter reference portion 58. Further, the slide protrusions 78 on the smaller diameter reference portion 60 are engaged with and guided into the guide grooves 73 in the base 57. With this, the smaller diameter reference portion 60 is movable in the axial direction of the base 57, but locked in the rotational direction to rotate together with the base 57.

Figure 4:
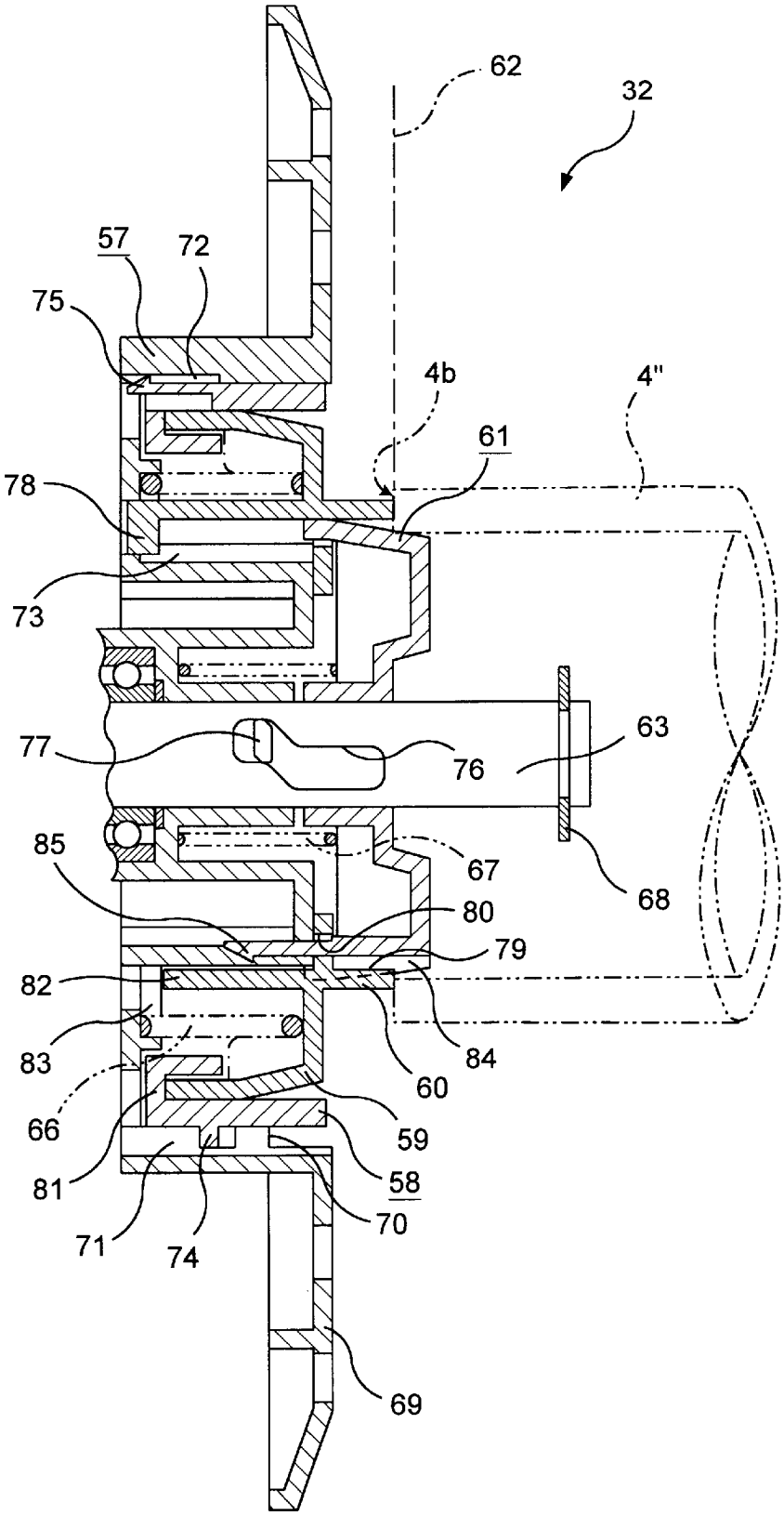
FIG. 4 is a plan view of a center cross-sectional view of the core holding mechanism holding a winding core of smaller diameter.

The shape of the cam grooves 76 and the positions of the cam protrusions 77 are configured such that when the winding core 4' of smaller diameter is made to contact with and pushed into the smaller diameter reference portion 60, the cam protrusions 77 guide the cam grooves 76 in the rotational direction to rotate the larger diameter reference portion 58, and the protrusions 74 on the larger diameter reference portion 58 come off the protrusion raising portions 70 and fall into the escape grooves 71, as illustrated in FIG. 4. Then, a bottom portion 81 of the larger diameter reference portion 58 is pushed in by the larger diameter centering portion 59 so that the larger diameter reference portion 58 and larger diameter centering portion 59 fall into the base 57 and recede from the periphery of the winding core 4". At the same time, the reference position 62 is determined such that a bottom portion 82 of the smaller diameter reference portion 60 comes into contact with the bottom portion 83 of the base 57 and the end face 4*b* of the winding core 4" is positioned a predetermined distance (for example, 7 mm) away from the inner surface of the flange 69. This also provides a countermeasure to the cause that hinders winding in the same manner as supporting the larger diameter core 4'. Although the gap between the flange 69 and winding core 4" is set 7 mm in this embodiment, it is not limited to this.

The smaller diameter centering portion 61 includes slide protrusions 84, which are guided into the guiding grooves 79 in the smaller diameter reference portion 60, and nails 85 which are caught by the edges of the engaging holes 80 in the smaller diameter reference portion 60. Therefore, the slide protrusions 84 on the smaller diameter centering portion 61 are engaged with the guiding grooves 79 in the smaller diameter reference portion 60 and guided thereto. Accordingly the smaller diameter centering portion 61 is movable in the axial direction of the smaller diameter reference portion 60, but is locked in the rotational direction to rotate together with the reference portion 60. Also, the pawls(nails) 85 of the smaller diameter centering portion 61 are caught in the engaging holes 80 to prevent the smaller diameter centering portion 61 and reference portion 60 from separating from each other.

The larger spring 66 is arranged as compressed to push open between the base 57 and smaller diameter reference portion 60. The smaller spring 67 is arranged as compressed to push open between the base 57 and smaller diameter centering portion 61.

When the winding core 4' of larger diameter is held by the winding core holding mechanism 8, the device is operated in the following manner. The end portion of the core 4' contacts the larger diameter centering portion 59 as illustrated in FIG. 3, and the core 4' is pushed in against the spring force of the larger spring 66 until the end face 4*a* thereof hits against the larger diameter reference portion 58. Then, the protrusions 74 on the larger diameter reference portion 58 come into contact with the protrusion raising portions 70 of the base 57, and the end face 4*a* of the core 4' is positioned at the reference position 62. When the corner portion of the inner diameter surface of the core 4' pushes the larger diameter centering portion 59 in, a centering is performed by the tapered surface. Moreover, since the spring force of the larger spring 66 is exerted, a sufficient rotational friction resistance can be provided to the rotational torque necessary for winding. To increase the rotational friction resistance necessary for holding the winding core 4, a plurality of narrow grooves may be cut along the axial direction on the outer circumference of the larger diameter centering portion 59.

When the winding core 4' of smaller diameter is held by the winding core holding mechanism 8, the device is operated in the following manner. The end portion of the core 4" contacts the smaller diameter centering portion 61 as illustrated in FIG. 4, and the core 4" is pushed in against the spring force of the smaller spring 67 until the end face 4*b* thereof hits against the smaller diameter reference portion 60. As the smaller diameter reference portion 60 is pushed in against the spring force of the larger spring 66, the cam protrusions 77 on the smaller diameter reference portion 60 come into contact with the cam grooves 76 cut in the larger diameter reference portion 58 and the larger reference portion 58 is rotated according to the inclination of the cam grooves 78. With the rotation of the larger diameter reference portion 58, the protrusions 74 on the larger diameter reference portion 58 come off the protrusion raising portions 70 of the base 57 and becomes movable deeper along the escape groove 71. As the winding core 4' is further pushed, the bottom portion 82 of the smaller diameter reference portion 60 hits against the bottom portion 83 of the base 57. This stops the pushing of the winding core 4".

Figure 2:
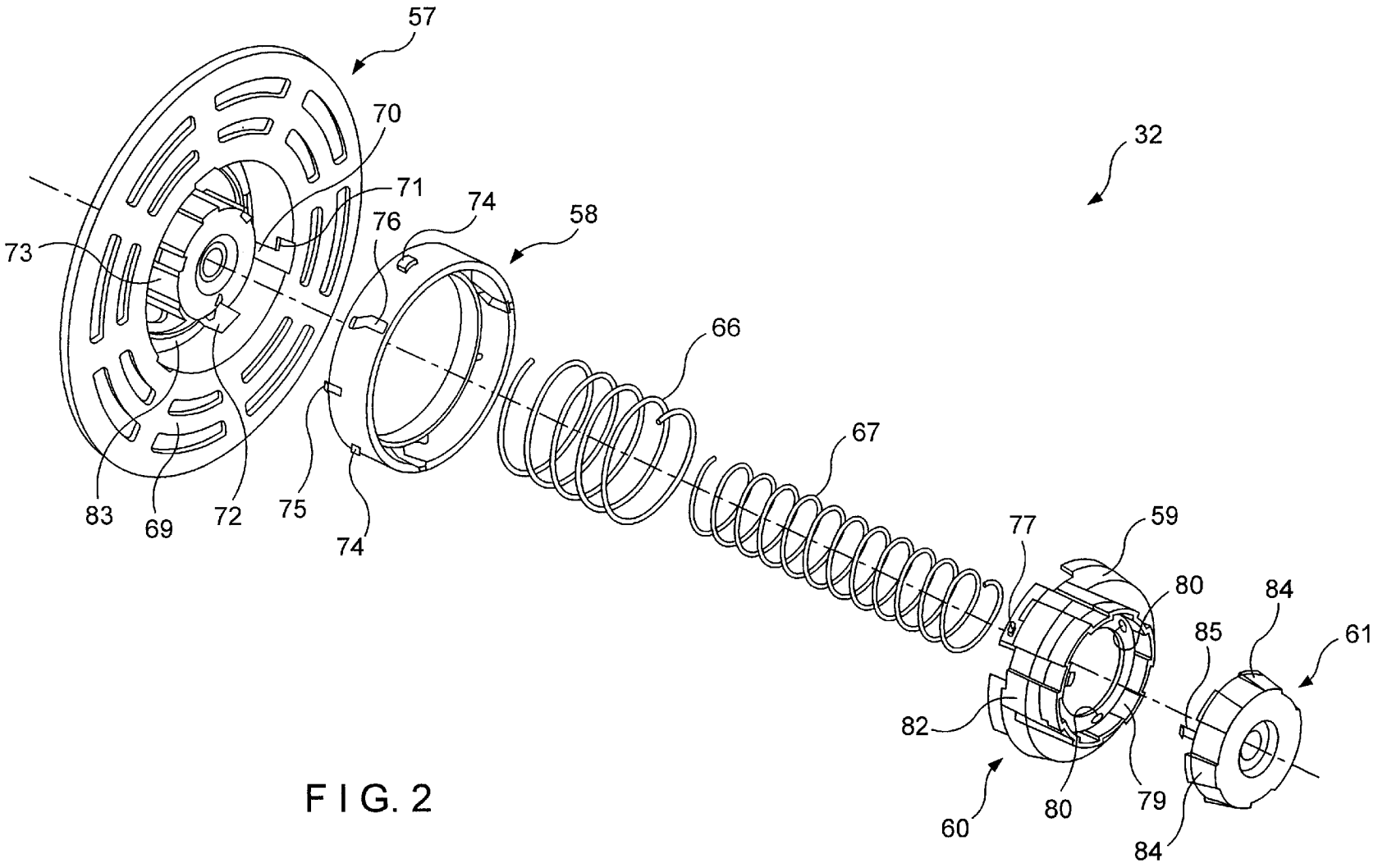
FIG. 2 is a dissembled view of the core holding mechanism.

When the core 4" is pushed in, the corner portion at the inner diameter surface of the core 4" contacts the tapered surface of the smaller diameter centering portion 61 to be centered. In addition, since the spring force of both springs 66 and 67 are exerted on the core 4", a sufficient rotational friction resistance can be given to the rotational torque necessary for winding. To increase the rotational friction resistance necessary for holding the core 4, a plurality of narrow grooves may be axially cut in the outer circumference of the smaller diameter centering portion 61, as illustrated in FIG. 2.

As the winding core 4" is removed and the pressing is stopped, the smaller centering portion 61 and smaller reference portion 60 are returned to the original positions as illustrated in FIG. 1 by the spring forces of springs 66 and 67. When the smaller reference portion 61 is pushed back, the cam protrusions 77 on the smaller reference portion 60 push up the inclined surfaces of the cam grooves 76 in the larger reference portion 58. Then, when the bottom surfaces of the protrusions 74 on the larger reference portion 58 are moved as low as the protrusion raising portions 70, the cam protrusions 77 rotate the larger reference portion 58 using the cam grooves 76. In the above manner, the device returns to the normal condition.

Figure 5:
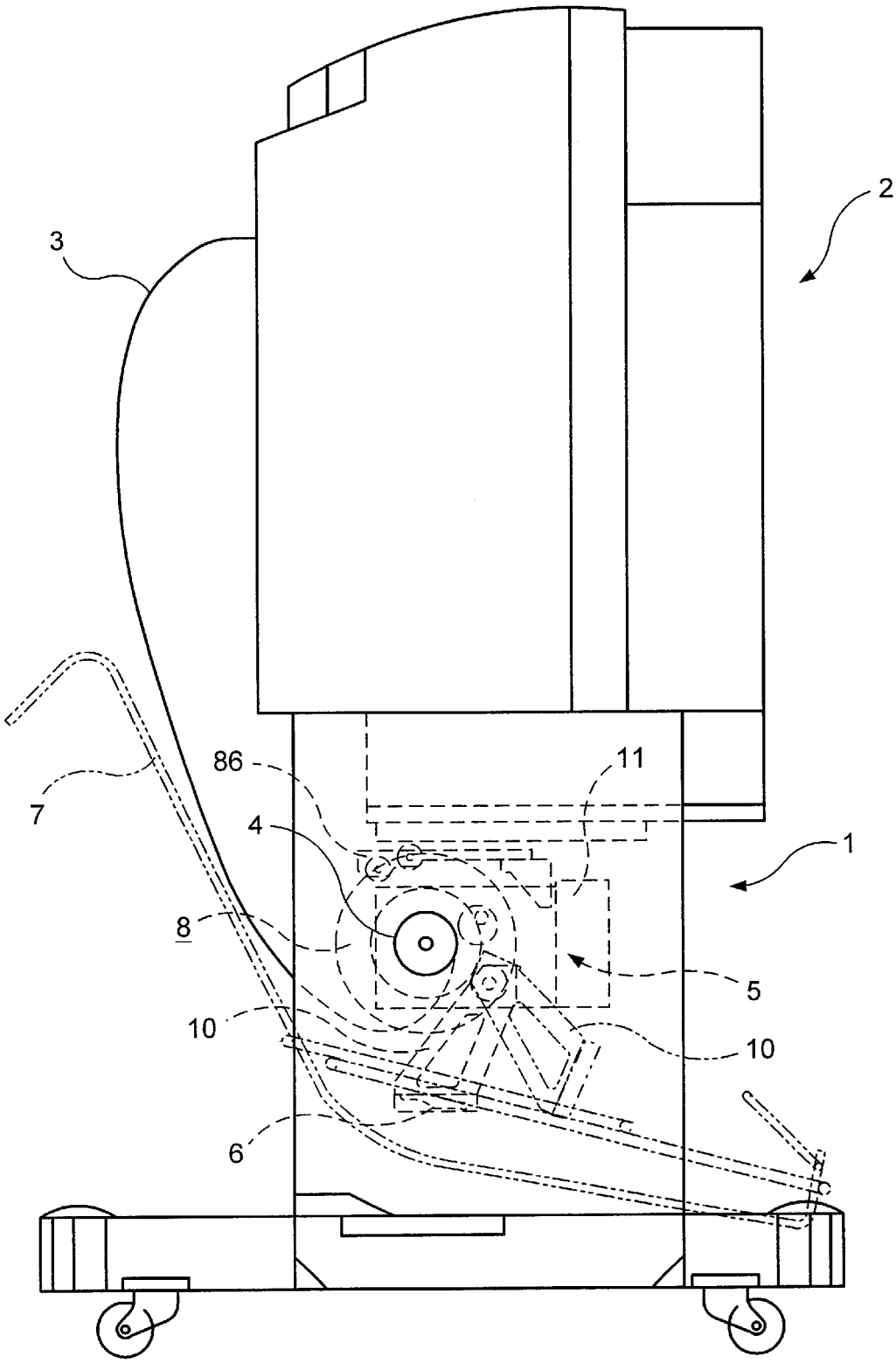
FIG. 5 is a side view of an entire printer in which a winding device of the present invention is used.
Figure 7:
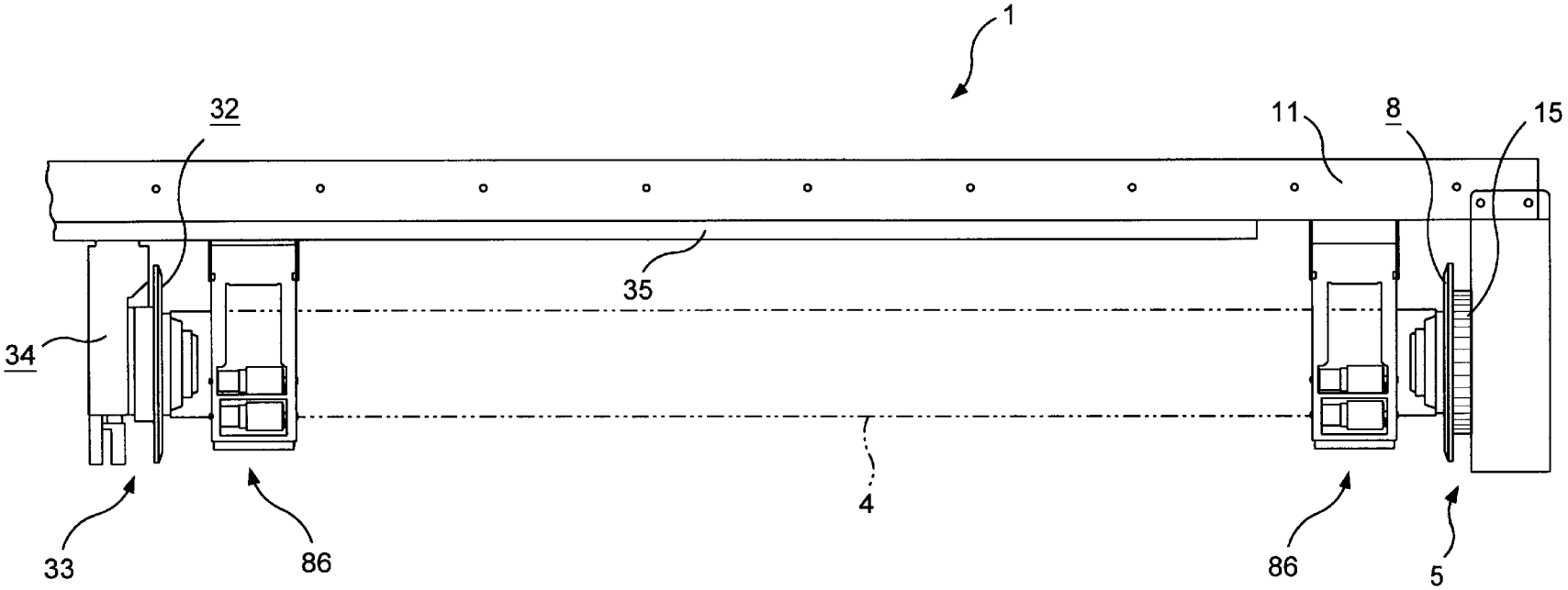
FIG. 7 is a plan view of the winding device.

The winding device 1 having the above mentioned winding core holding mechanisms 8 and 32 and a roll medium holding device 33, which will be described later, is now described. As illustrated in FIGS. 5 through 7, the winding device 1 comprises a winding mechanism 5 and a looseness-detecting sensor 6. The winding mechanism 5 winds the medium 4 output by the printer 2 on the winding core 4. The looseness-detecting sensor 6 detects looseness of the medium 3 and actuates the winding mechanism 5 upon detection. The looseness-sensor 6 is also capable of receding from the moving area of the medium 3 when the sheet tray 7 is attached to the printer 2. For this reason, even when the sheet tray 7 is attached to the printer 2 for stocking up the cut medium 3, the medium 3 is prevented from interrupting the looseness-detecting sensor 6. There is no need to detach/attach a whole or part of the winding device 1 even when the sheet tray 7 is attached/detached.

Used as the winding core 4 is a paper tube made of cardboard, which is the same kind as that used for a blank medium 3 to be set in the printer. The winding core 4 is not limited to such a paper tube, but it is understood that the core may be a tube exclusively used for this purpose.

In this embodiment, the looseness-detecting sensor 6 is attached to the winding mechanism 5 by a sensor arm assembly 10, as illustrated in FIGS. 8 through 12. The winding mechanism 5 has a pair of winding core holding mechanisms 8 and 32 that support the winding core 4 by holding both ends of the core 4, a motor mechanism 9 that drives at least one of the winding core holding mechanisms 8, 32 (for example, the winding core holding mechanism 8 on the right side in FIG. 2 here) as the looseness-detecting sensor 6 detects looseness of the medium 3, and spool supporting board 12 and spool reinforcing board 13 that support and fix the winding core holding mechanism 8, motor mechanism 9, and sensor arm assembly 10 on the stay 11 of the printer 2.

The motor mechanism 9 has a built-in decelerating gear train. A gear portion 15 is formed around an outer periphery of a boss portion 14 of the winding core holding mechanism 8. A pinion 16 of the motor mechanism 9 is meshed with the gear portion 15 of the winding core holding mechanism 8. Note that a code 17 in FIGS. 8 and 10 indicates a cover.

The sensor arm assembly 10 includes a sensor arm 18 that supports the looseness-detecting sensor 6 to be capable of swinging, an arm rotary shaft 19 that rotatably supports the sensor arm 18 with respect to the winding mechanism 5 and rotates together with the sensor arm 18, a friction plate 20 united with the sensor arm 18 and arm rotary shaft 19, a clutch gear 21 that meshes with the gear portion 15 of the winding core holding mechanism 8 and is in contact with the friction plate 20, a spring 22 composed of a compressed coil spring that presses the clutch gear 21 onto the friction plate 20, and a spring basket 23 that supports one end of the spring 22, the other end of which faces the clutch gear 21.

The arm rotary shaft 19 passes through a substantially U-shaped supporting portion 24 formed at the upper end of the sensor arm 18 and both ends thereof are fixed by E-rings 25. When the arm rotary shaft 19 is inserted into a supporting portion 24 of the sensor arm 18, the friction plate 20, clutch gear 21, spring 22, spring basket 23, and spacer 26 are installed inside the supporting portion 24 in this order. When the spring 22 is installed, it is compressed. The clutch gear 21 is pressed by the force exerted by the spring 22 onto the friction plate 20. The arm rotary shaft 19 and friction plate 20 are secured to the sensor arm 18 with a D-cut fitting, etc. so that they rotate together with the sensor arm 18 as a single unit. In this embodiment, the arm rotary shaft 19 is formed like a tube. A cord 27 from the looseness-detecting sensor 6 passes through the inside of the arm rotary shaft 19.

One end of the arm rotary shaft 19 projecting from the sensor arm assembly 10 is rotatably fitted into a hole in the spool supporting plate 12 via the spacer 26. The other end of the arm rotary shaft 19 projecting from the sensor arm assembly 10 is rotatably fitted into a hole in the spool reinforcing board 13 via the spacer 26. Then, the spool reinforcing plate 13 is screwed onto the spool supporting board 12 to sandwich the sensor arm assembly 10.

The sensor arm assembly 10 is rotatable about the arm rotary shaft 19 with respect to the spool reinforcing board 13 and spool supporting board 12. At that time, the arm rotary shaft 19, sensor arm 18, and friction plate 20 rotate together as a single unit within a limited range that will be described later.

The looseness-detecting sensor 6 is a mechanical contact-type sensor that performs detection with the contact of the medium 3 and is united with the winding mechanism 5. Since the sensor is of a contact-type, the detection is kept accurate, while it may be degraded with an optical sensor because the optical axis of the sensor is intercepted due to contamination or shifted after installation. Thus, reliability of detection can be improved. Because the looseness-detecting sensor 6 is united with the winding mechanism 5, there is no need to wire the sensor with the winding mechanism 5, which is normally required when the optical sensor is used in the printer 2. This simplifies the operation of installing the sensor in the printer 2.

Figure 8:
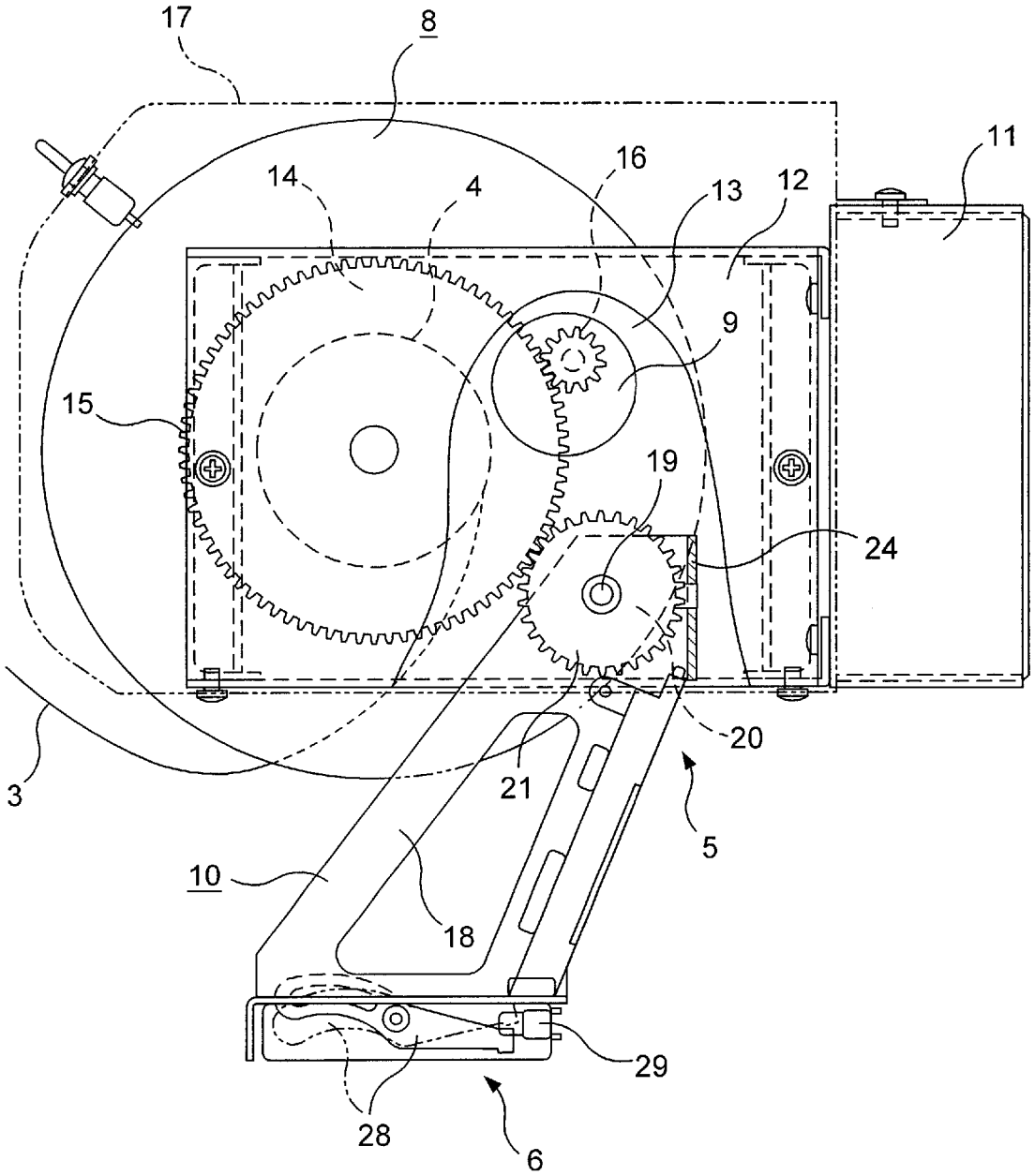
FIG. 8 is a side view of the winding device when a looseness-detecting sensor is at the detecting position.
Figure 9:
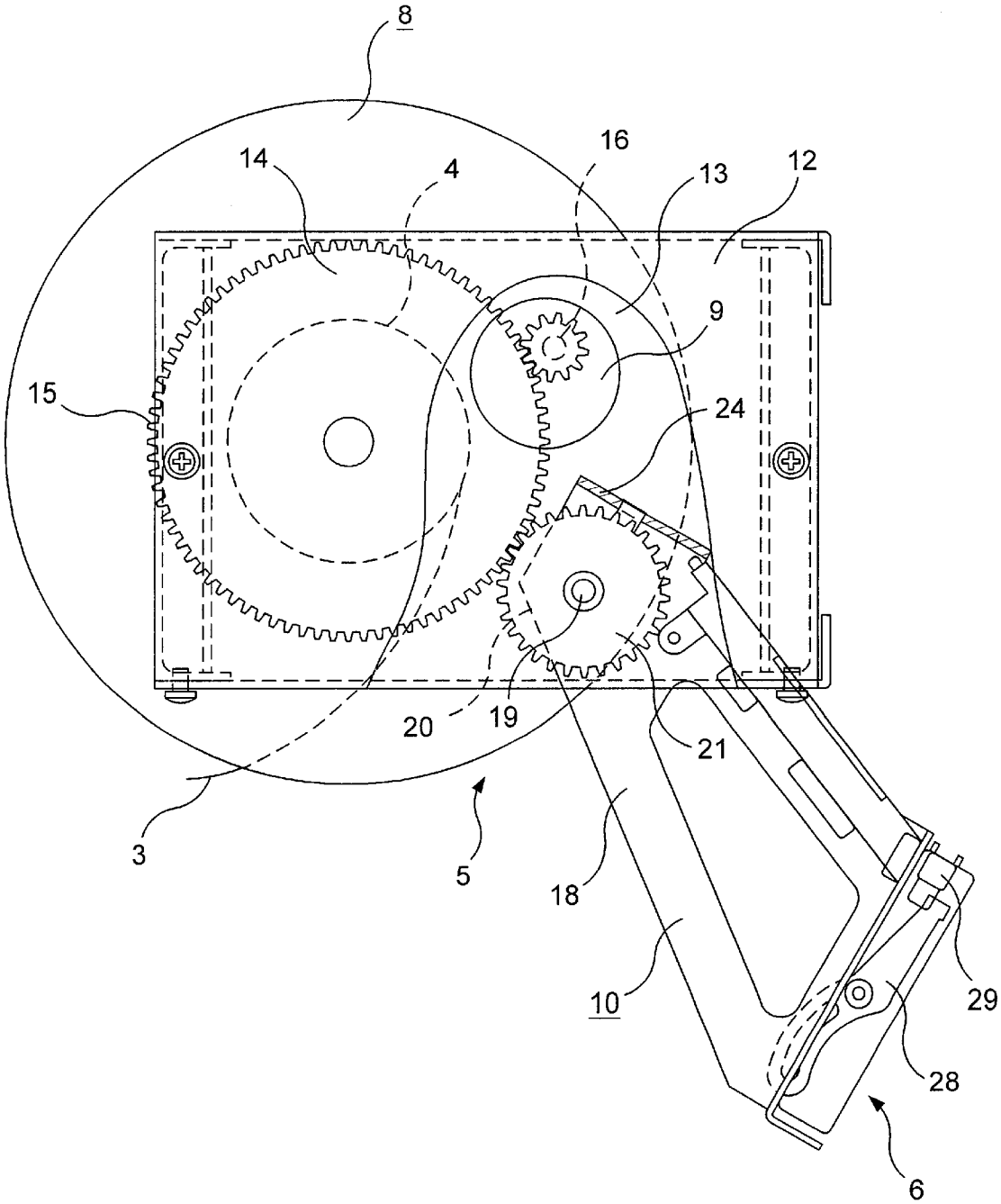
FIG. 9 is a side view of the winding device when the looseness-detecting sensor is at the receding position.
Figure 10:
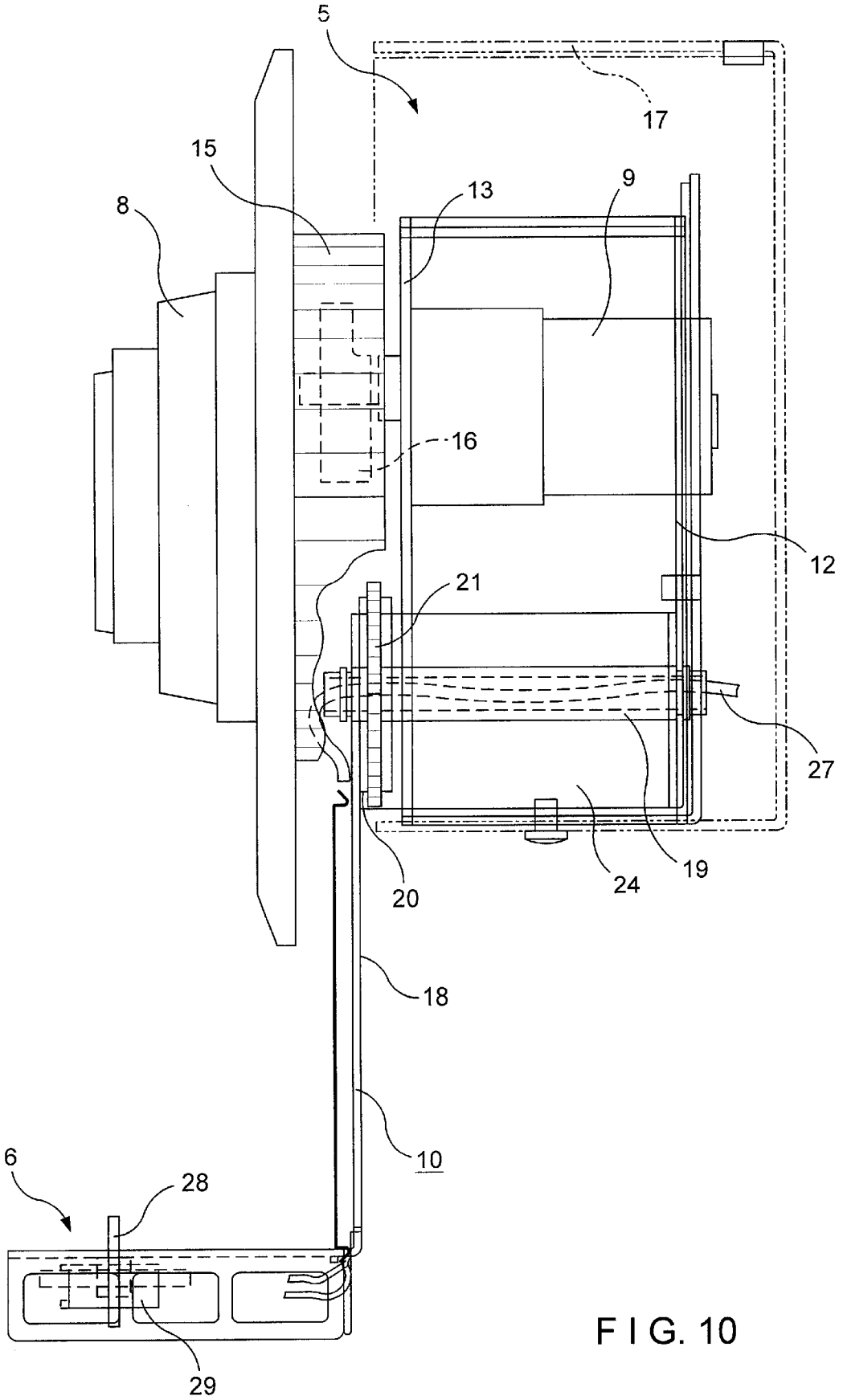
FIG. 10 is a front view of the winding device when the looseness-detecting sensor is at the detecting position.
Figure 11:
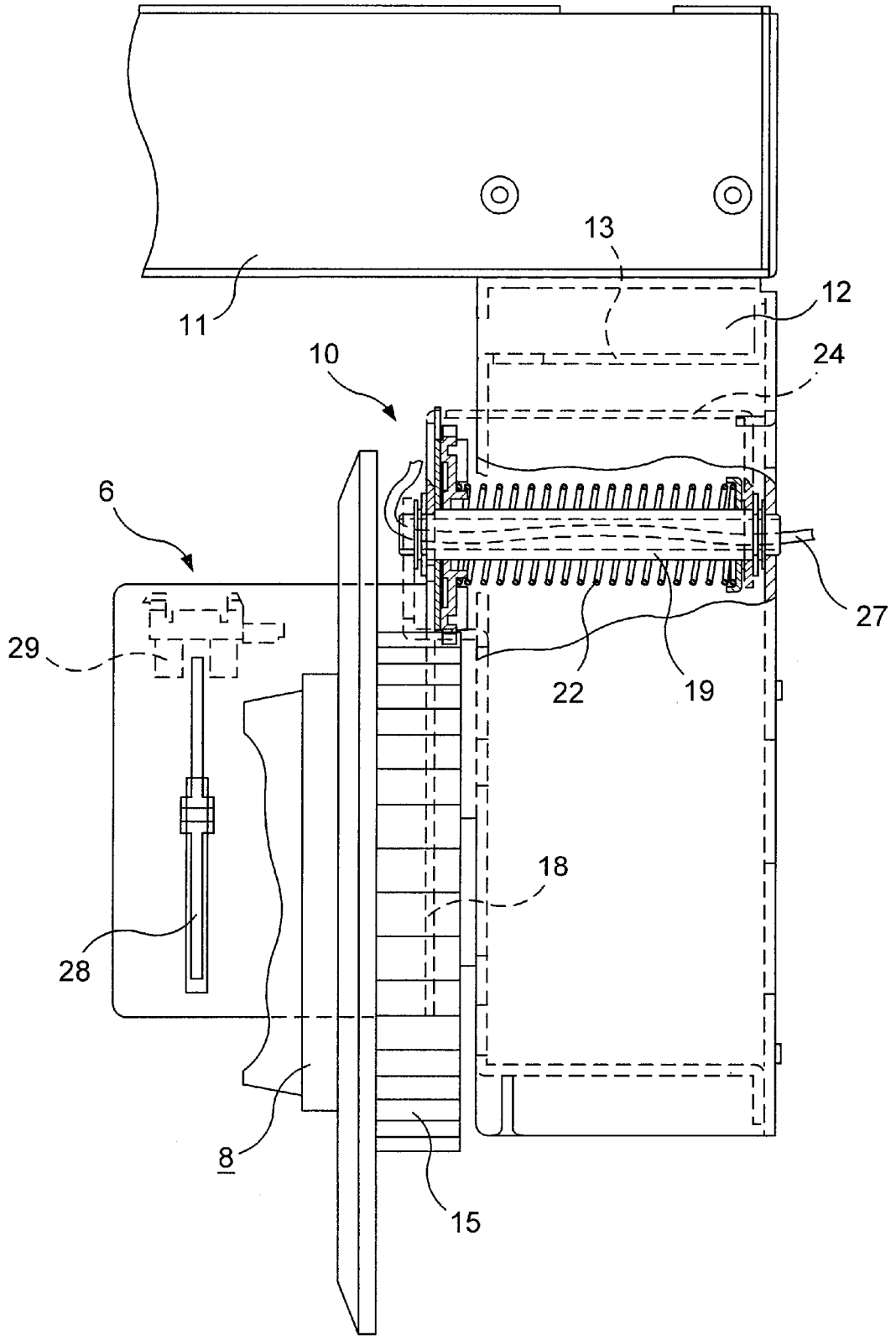
FIG. 11 is a plan view of the winding device when the looseness-detecting sensor is at the detecting position.
Figure 12:
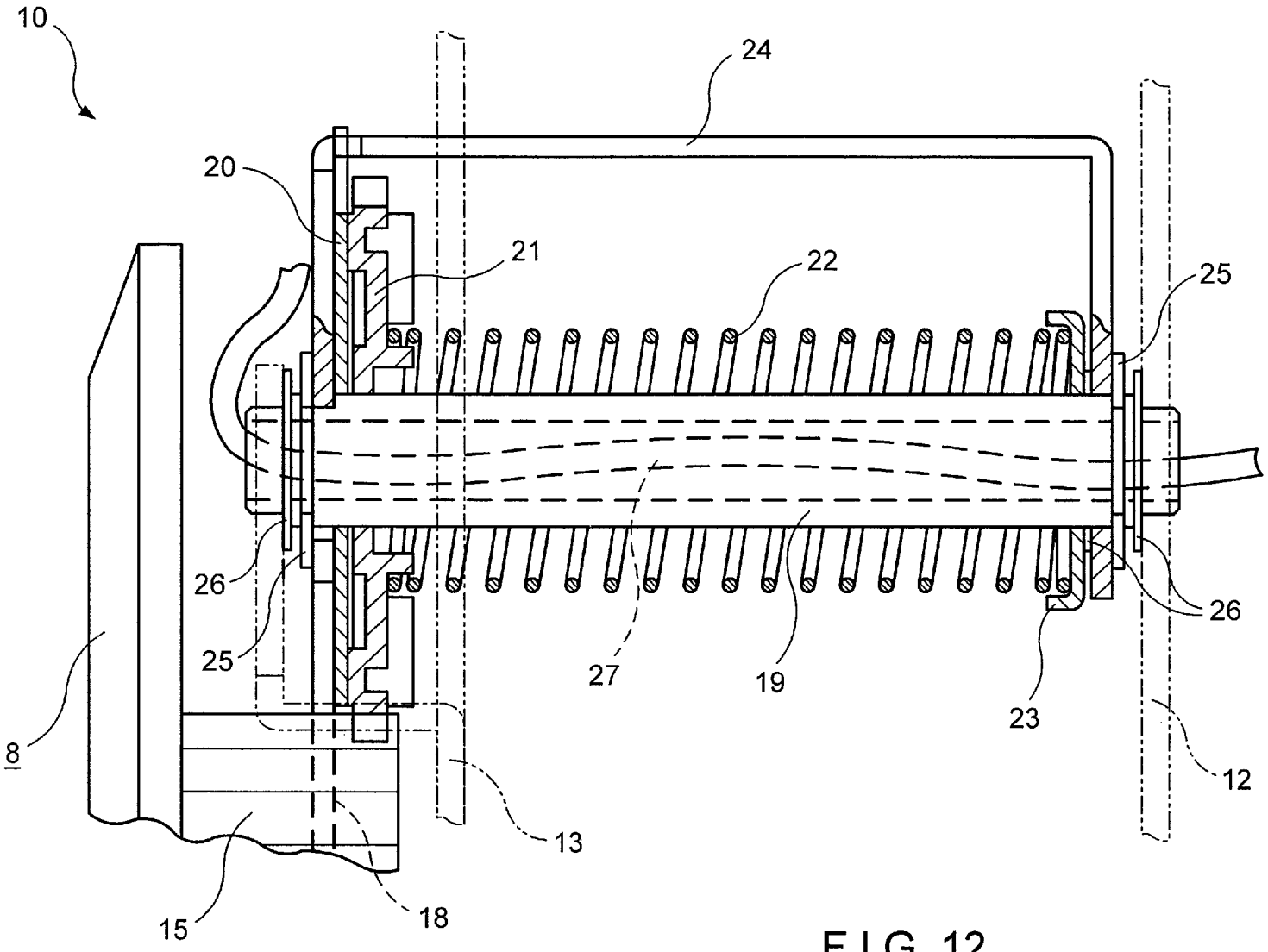
FIG. 12 is a front view of a major portion of a sensor arm assembly.
Figure 13:
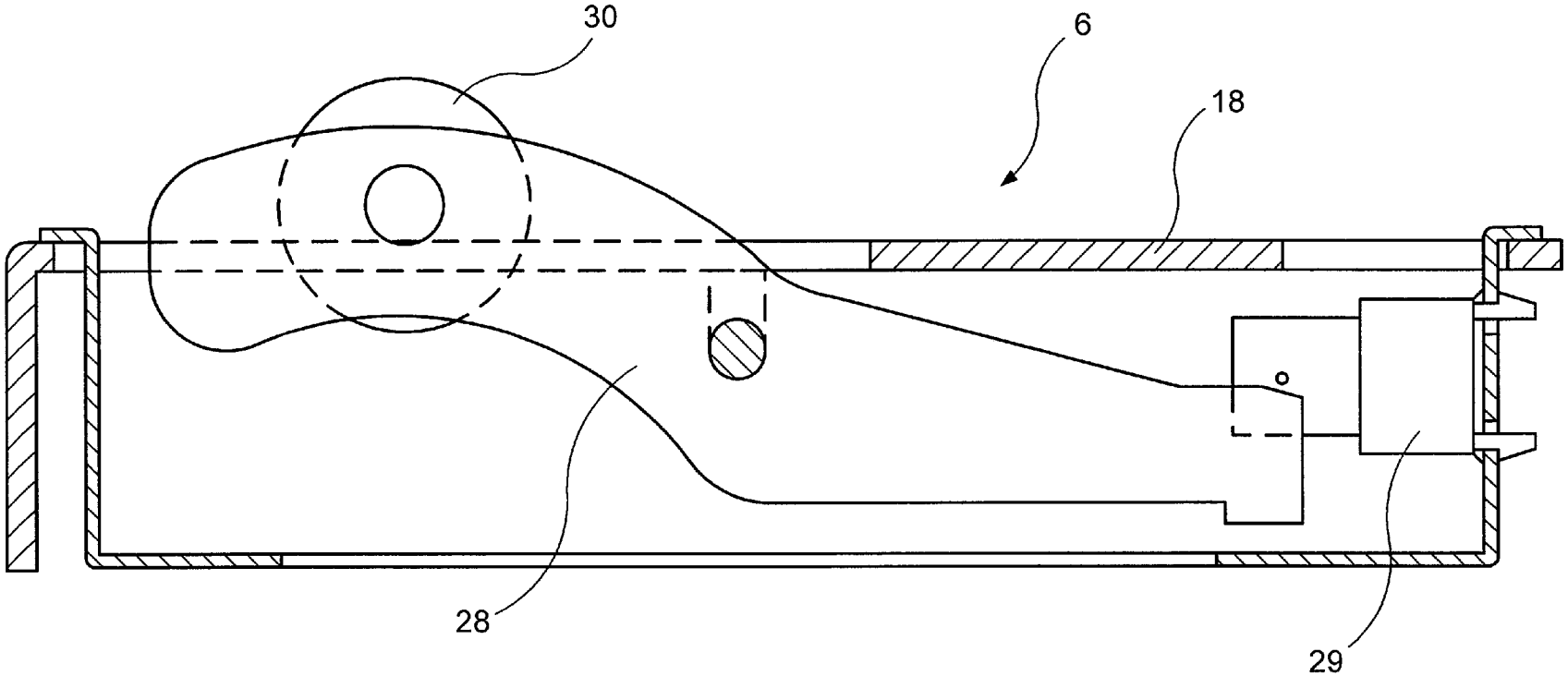
FIG. 13 is a side view of another embodiment of the contact lever.
Figure 14:
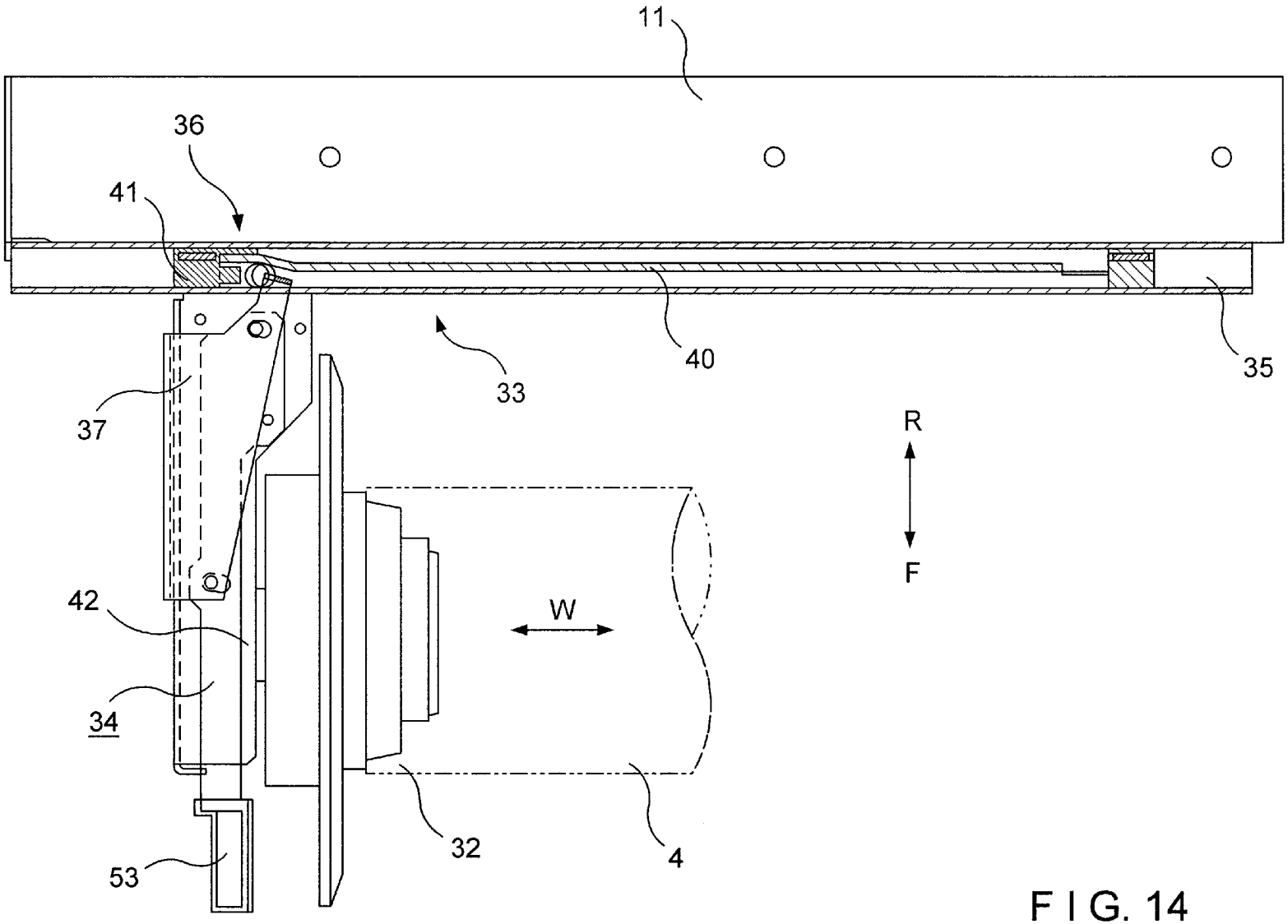
FIG. 14 is a plan view of a roll medium holding device.

The looseness-detecting sensor 6 has a contact lever 28, which is attached to the bottom portion of the sensor arm 18 to be capable of swinging, and a photo sensor 29 for detecting the swing of the contact lever 28. The contact lever 28 is swung by the contact of the medium 3, and this movement is detected by the photo sensor 29. The contact lever 28 is capable of swinging with a very small force. In other words, the contact lever 28 is normally in a raised position (shown by a solid line in FIG. 8), and the weight thereof is well-balanced so that the sensor 6 swings down to a lower position (shown by the double-dotted line in the same figure) with a very small force. With this, the lever 28 is protected from bending or damage when the medium 3 comes into contact therewith. Note that the contact portion of the contact lever 28 with the medium 3 can be made in a circular arc shape as shown in FIGS. 8 and 9, or a rotatable roller 30 may be attached to the sensor as shown in FIG. 13 to reduce contact resistance.

As illustrated in FIGS. 14 through 19, the roll medium holding device 33 includes a slider portion 34 fixed to the core holding mechanism 32 and a guide portion 35 supporting the slider portion 34 to be capable of sliding along the width direction W of the medium 3. The roll medium holding device 33 also includes a locking means 36, which locks the slider portion 34 from sliding in the direction moving away from the winding core 4, and an unlocking means 37 which can unlock the locking means 36. The sliding portion 34 is pushed and slid toward the winding core 4 for attaching the winding core 4. Since the locking means 36 is not operating at that time, the slider portion 34 can be slid easily. After the winding core holding mechanism 32 contacts and holds the winding core 4, the pushing effect on the slider portion 34 is stopped. At that time, the slider portion 34 never moves in the direction away from the winding core 4 because of the effect of the locking means 36, maintaining a good holding condition of the winding core 4. Accordingly the winding core 4 can be installed by a one-touch operation. To remove the winding core 4, the unlocking means 37 is operated to slide the slider portion 34 and winding core holding mechanism 32. Accordingly the winding core 4 can be removed by an easy operation almost like a one-touch operation.

Figure 16:
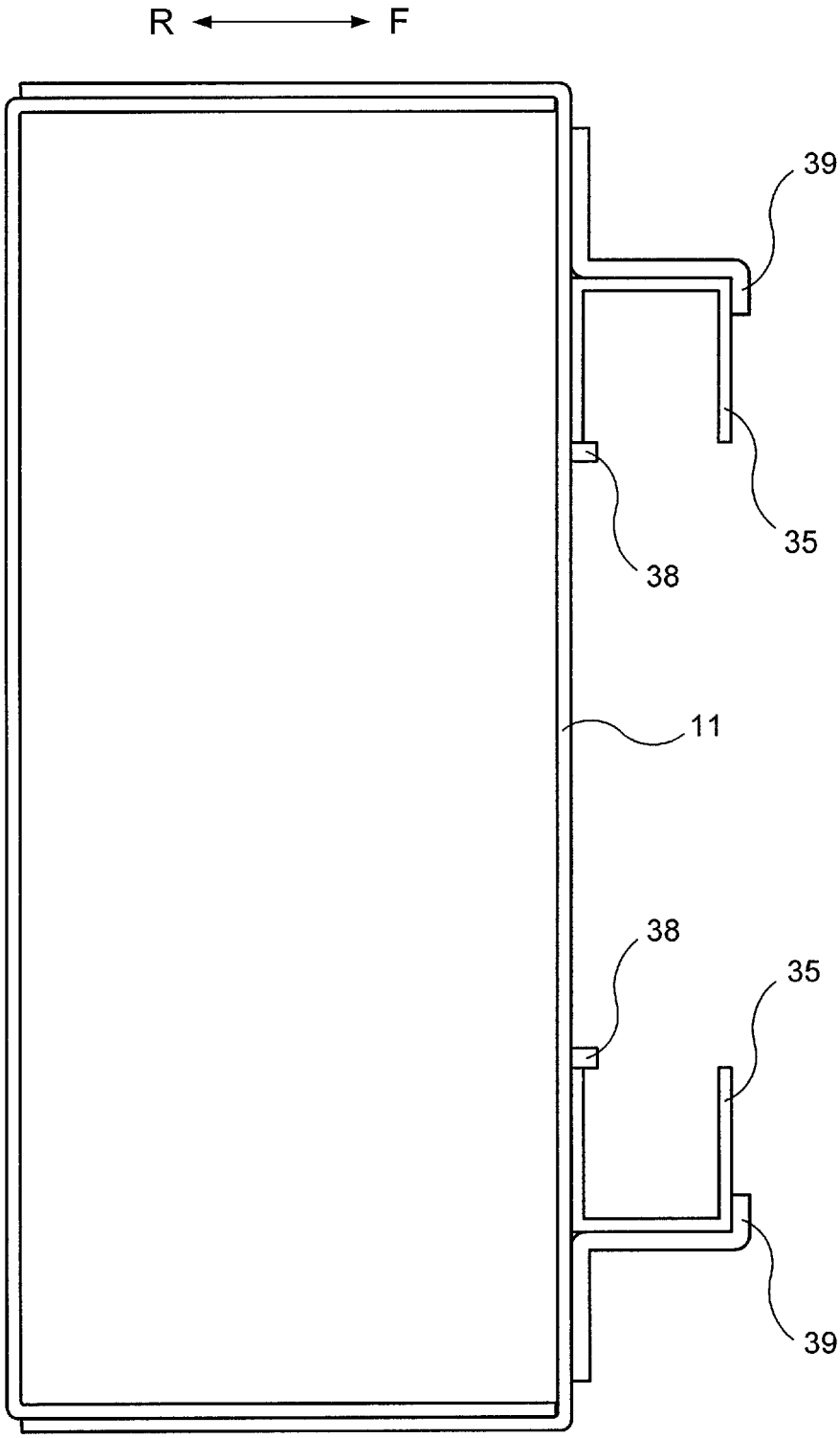
FIG. 16 is a side view of a guiding portion.
Figure 17:
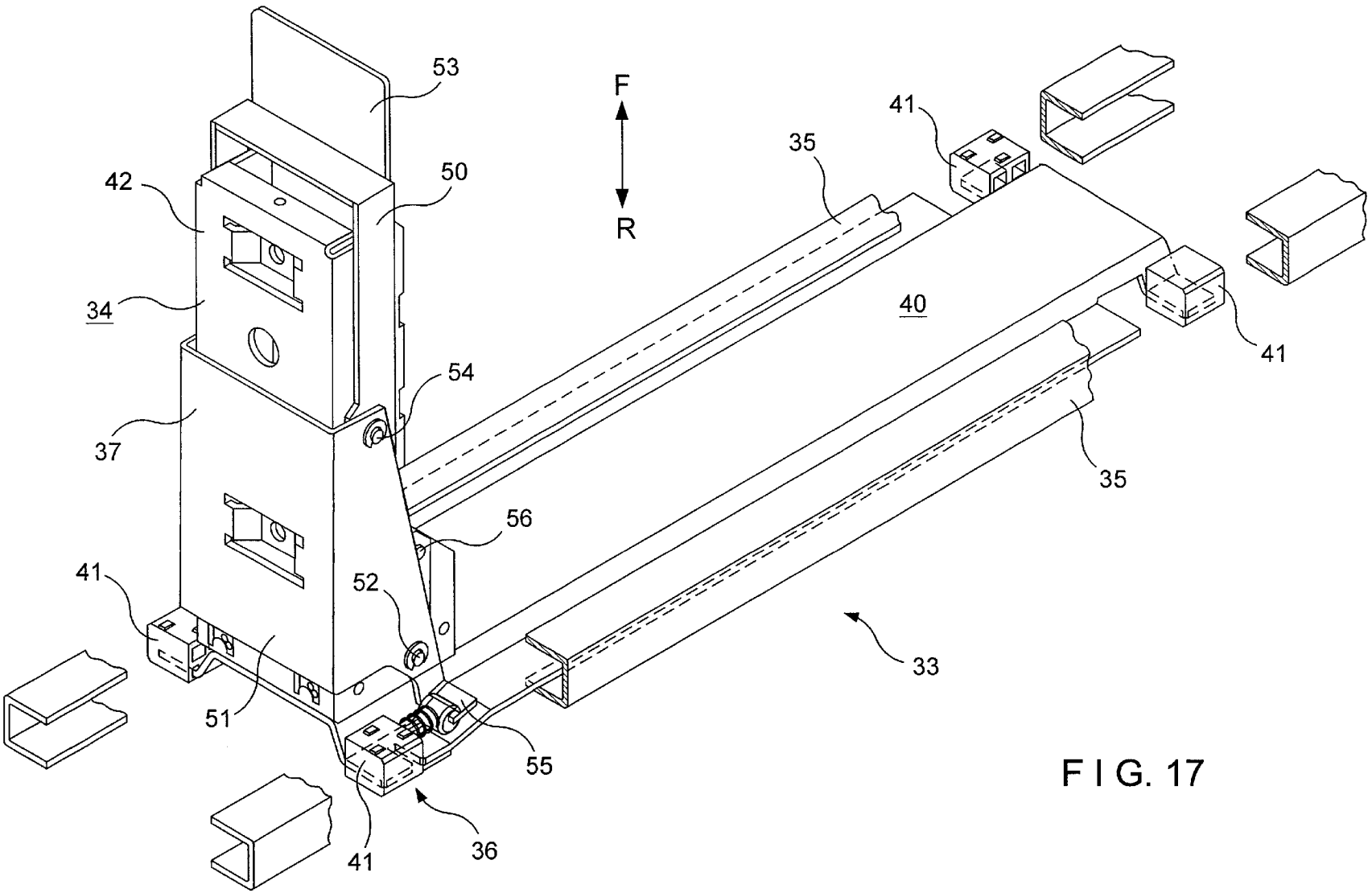
FIG. 17 is a perspective view of the major portion of the roll medium holding device.

The guiding portions 35 are composed of guiding rails extending along the stay 11 formed in the width direction W of the printer 2 from the left end to the vicinity of the right end of the winding device 1. The guiding portions 35 are channel components, each of which has a substantially U-shaped cross-section; they are arranged at the top and bottom so that the open ends of substantial U-shape face each other. As illustrated in FIG. 16, each of the guiding portions 35 is positioned by hitting against a positioning projection 38 which is formed at the stay 11 in the horizontal direction. Each guiding portion 35 is positioned in the above manner, and then held in a guiding rail securing plate 39 and tightly secured to the stay 11. In this embodiment, the guiding portion is tightly secured by a screw.

Figure 18:
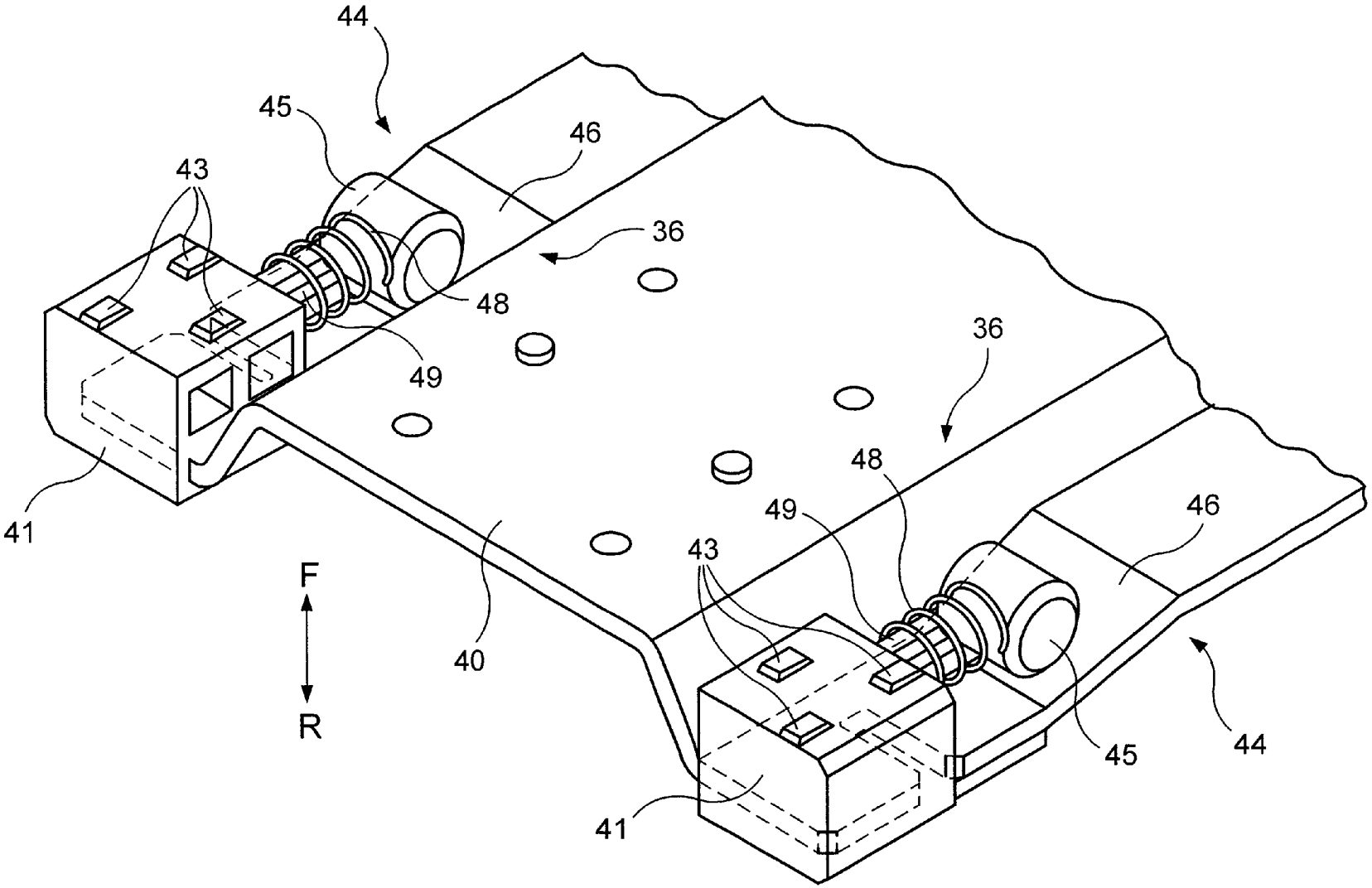
FIG. 18 is a perspective view of a locking means.

The slider portion 34 includes a slide plate 40, sliding blocks 41 attached at the four comers of the slide plate 40, and a supporting stay 42 for an operator to perform a sliding operation. The sliding blocks 41 are fitted at the four corners of the slide plate 40, as illustrated in FIG. 18, etc. Contact points 43 are formed on the front F surfaces and back R surfaces of the sliding blocks 41 to make contact with inner surfaces of the guiding portions 35. Consequently the contact area of the guiding portions 35 with the sliding blocks 41 can be reduced to a minimum to reduce resistance when sliding. One of the four sliding blocks 41 is not formed with the contact points 43. Therefore, even if the guiding portions 35 are distorted due to errors in dimensions or assembly, the slider portion 34 can be slid easily.

Figure 20:
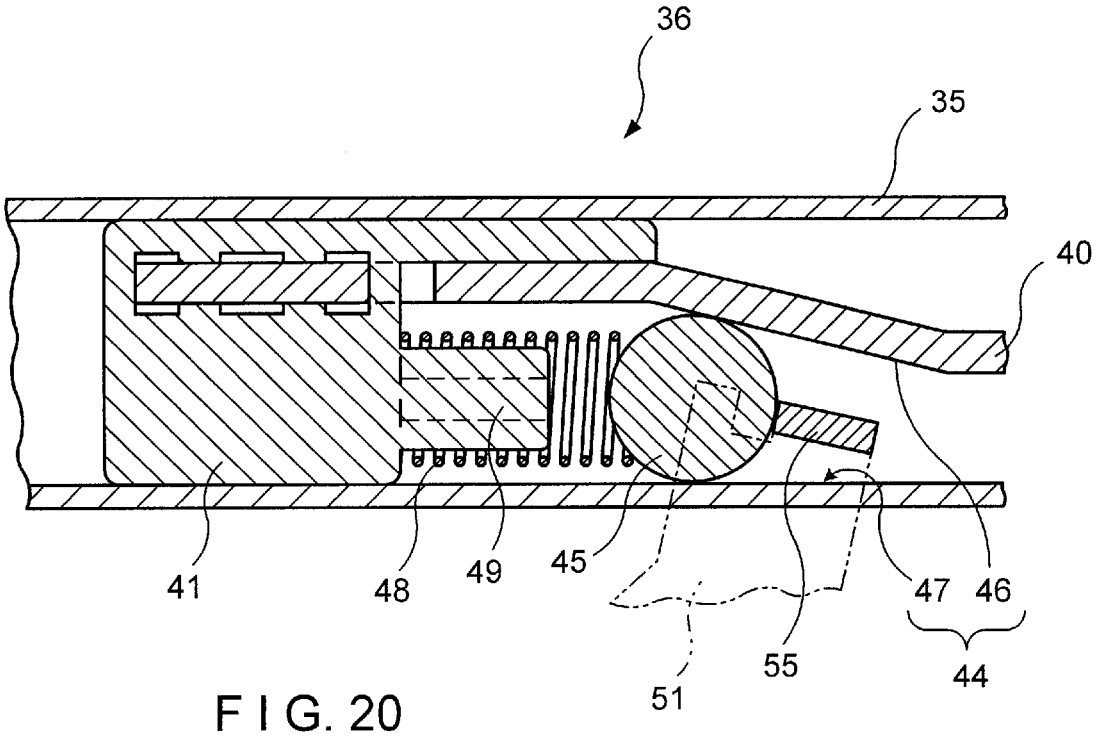
FIG. 20 is a plan view of the locking means at work.
Figure 21:
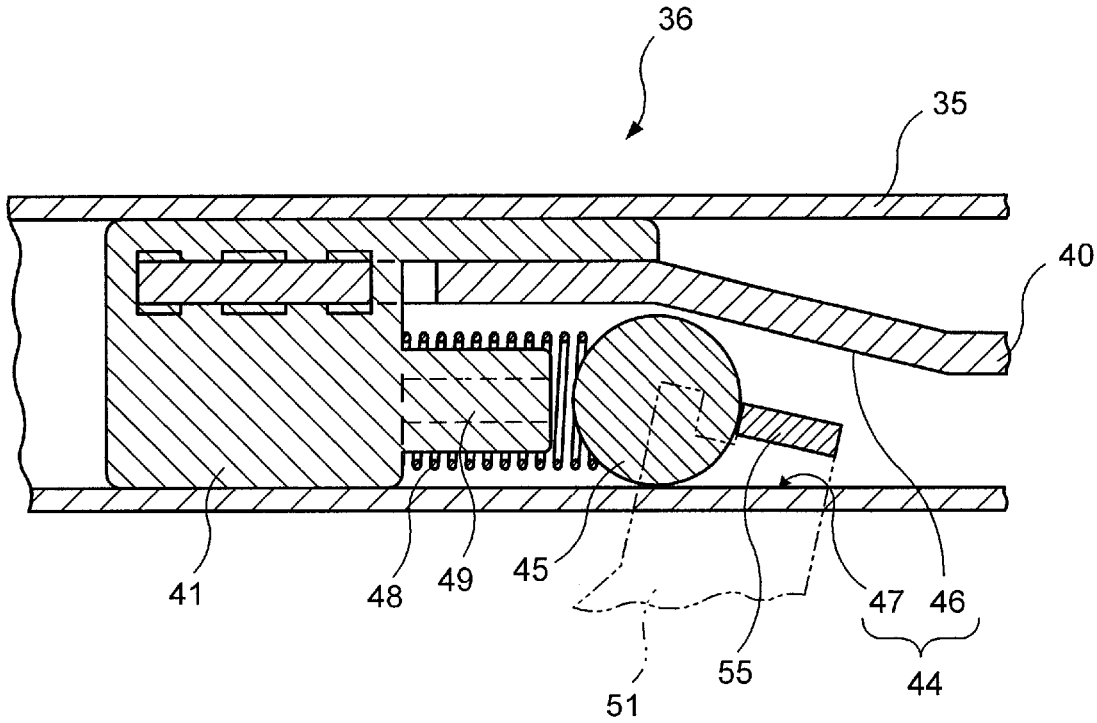
FIG. 21 is a plan view of the condition under which the locking means is unlocked.

The locking means 36 includes wedge-shaped facing planes 44 provided between the slider portion 34 and guiding portions 35, and a stopper member 45 that creeps in and widens the space between the facing planes 44 to lock relative movement of the slider portion 34 and guiding portions 35. Consequently the locking means 36 can be configured with a simple mechanism, thus reducing the cost for the roll medium holding device 33. In this embodiment, as illustrated in FIGS. 20 and 21, the facing planes 44 consist of an inclined surface 46 constructed inside the guiding portion 35 of the slide plate 40 and an inner surface 47 of the guiding portion 35 that is opposed to the inclined surface 46.

The stopper member 45 is composed of a metallic cylindrical roller, for example. Also, a spring 48 composed of a compressed coil spring is provided between the sliding block 41 and the stopper member 45 to push the stopper member 45 into the space between the facing planes 44. The spring 48 is supported by a spring supporting projection 49 on the sliding block 41. Although the stopper member 45 is composed of a cylindrical roller in this embodiment, it may be formed in a spherical shape or a wedge shape. With either shape, the stopper member 45 moves into the space between the facing planes 44 to lock relative movement between the slider portion 34 and the guiding portions 35.

The core 4 is installed in the following manner. As the slider portion 34 is pushed toward the core 4, the stopper member 45 escapes from the space between the facing planes 44. Therefore, the slide plate 40 is not locked and can be slid easily. As the sliding-side winding core holding mechanism 32 abuts to the core 4 and holds it, the pressing of the slider portion 34 is stopped. Since the spring 48 has pushed the stopper member 45 into the space between the facing planes 44, even when the operator's hand is released or the slider portion 34 is pushed in the direction away from the core 4 as illustrated in FIG. 20, the stopper member 45 moves to creep in the space between the facing planes 44.

Consequently the sliding plate 40 is locked onto the guiding portions 35. Thus, both ends of the core 4 are held by the winding core holding mechanisms 8 and 32 on the left and right sides, which maintains the holding condition.

Figure 15:
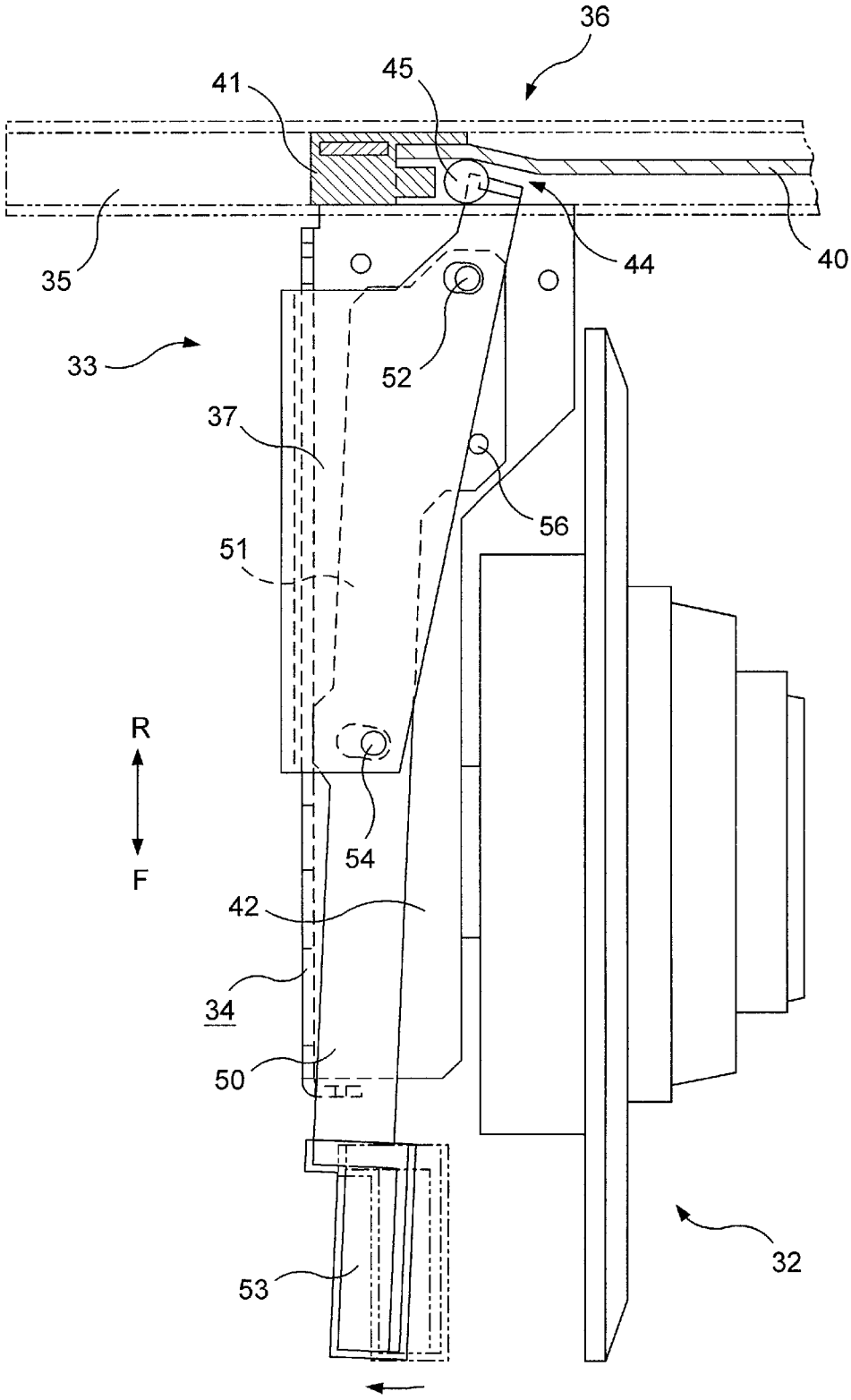
FIG. 15 is a plan view of a major portion of the roll medium holding device.
Figure 19:
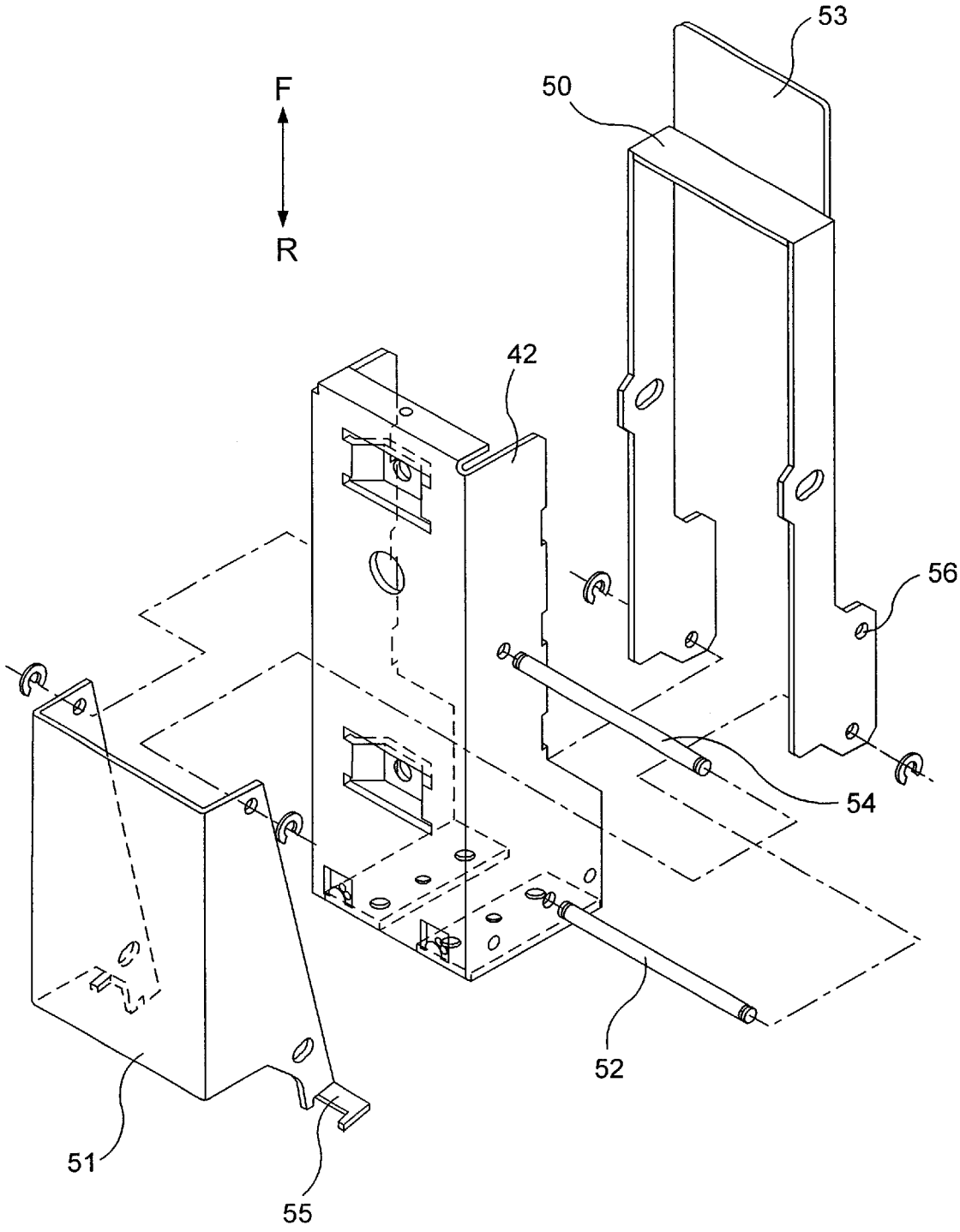
FIG. 19 is a dissembled view of an unlocking means.

The unlocking means 37 includes operation lever 50 and unlocking lever 51 which are attached to the supporting stay 42 to be capable of swinging, as illustrated in FIG. 19. The operation lever 50 is supported at the portion of the supporting stay 42 on the sliding plate 40 side, i.e., on the rear side R by a rotary shaft 52, and also has an operating portion 53 projecting to the front side F. The unlocking lever 51 is supported at the center of the supporting stay 42 by a rotary shaft 54, and has a pressing portion 55 that presses the stopper member 45 in the direction to move off the space between the facing planes 44 by the swing thereof. The operation lever 50 is formed with a lever pushing protrusion 56 that swings the unlocking lever 51 when the lever 50 is rotated about the rotary shaft 52. As illustrated in FIG. 15, as the operating portion 53 of the operation lever 50 is pushed in the arrow direction, the operation lever 50 is swung, and the lever pushing protrusion 56 swings the unlocking lever 51. Then, as illustrated in FIG. 21, as the pressing portion 55 moves the stopper member 45 out of the space between the facing planes 44, the slider portion 34 is unlocked.

In this embodiment, as the operation lever 50 is moved in the direction to which the slider portion 34 recedes (in the arrow direction in FIG. 15), the unlocking lever 51 moves the stopper member 45 out of the space between the facing planes 44. In other words, the operation direction of the unlocking means 37 is same as the direction in which the guiding portion 35 is receded. For this reason, the unlocking means 37 is operated simultaneously with the receding operation of the slider portion 34 by a one-touch button operation. This improves operability.

Also, the unlocking means 37 is equipped with the operation lever 50 and unlocking lever 51 and the swing of the operation portion 53 swings the pressing portion 55 with the effect of a lever. For this reason, even when the stopper member 45 is tightly stuck between the facing planes 44, it can be moved with a small force.

Figure 22:
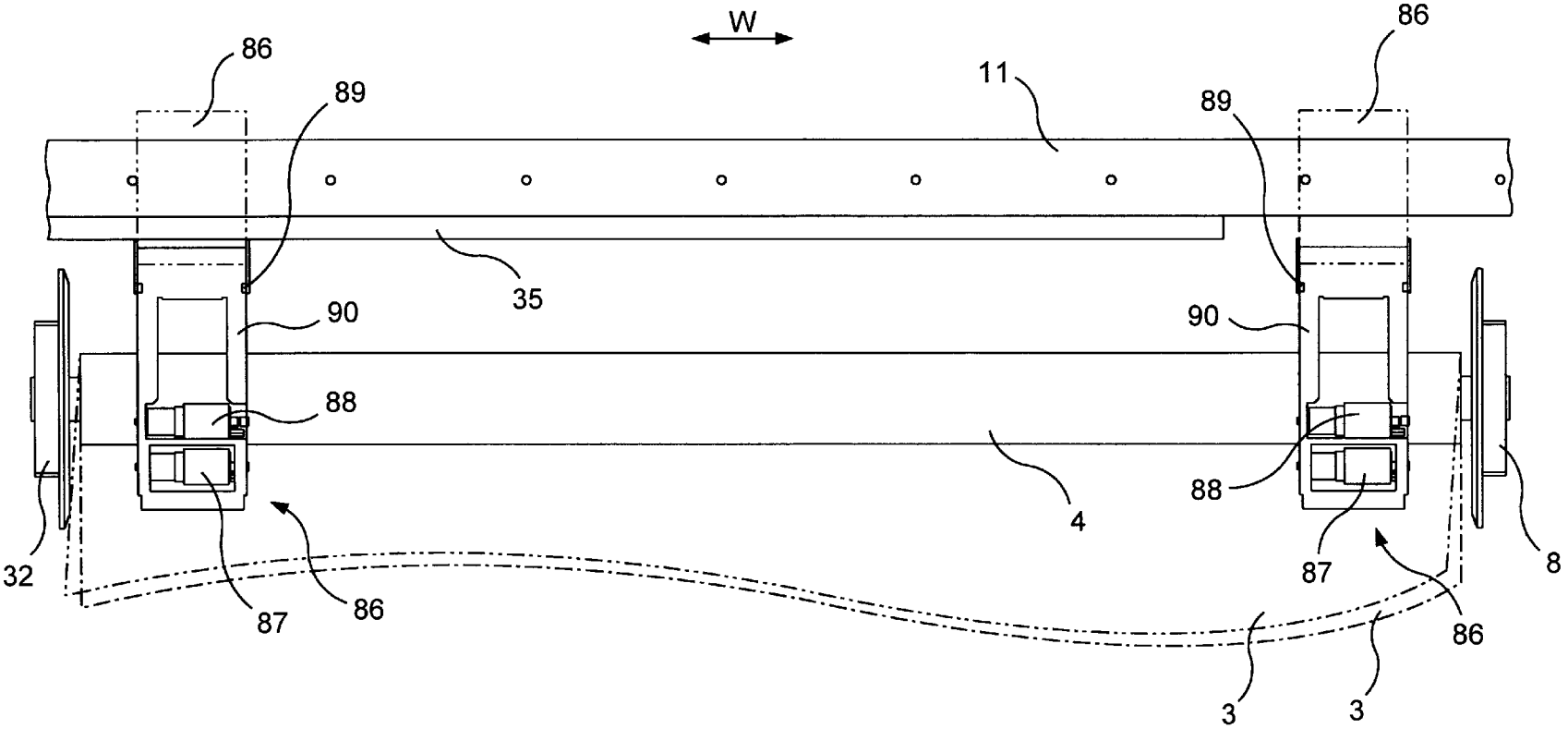
FIG. 22 is a plan view of an obliquely wound medium.
Figure 23:
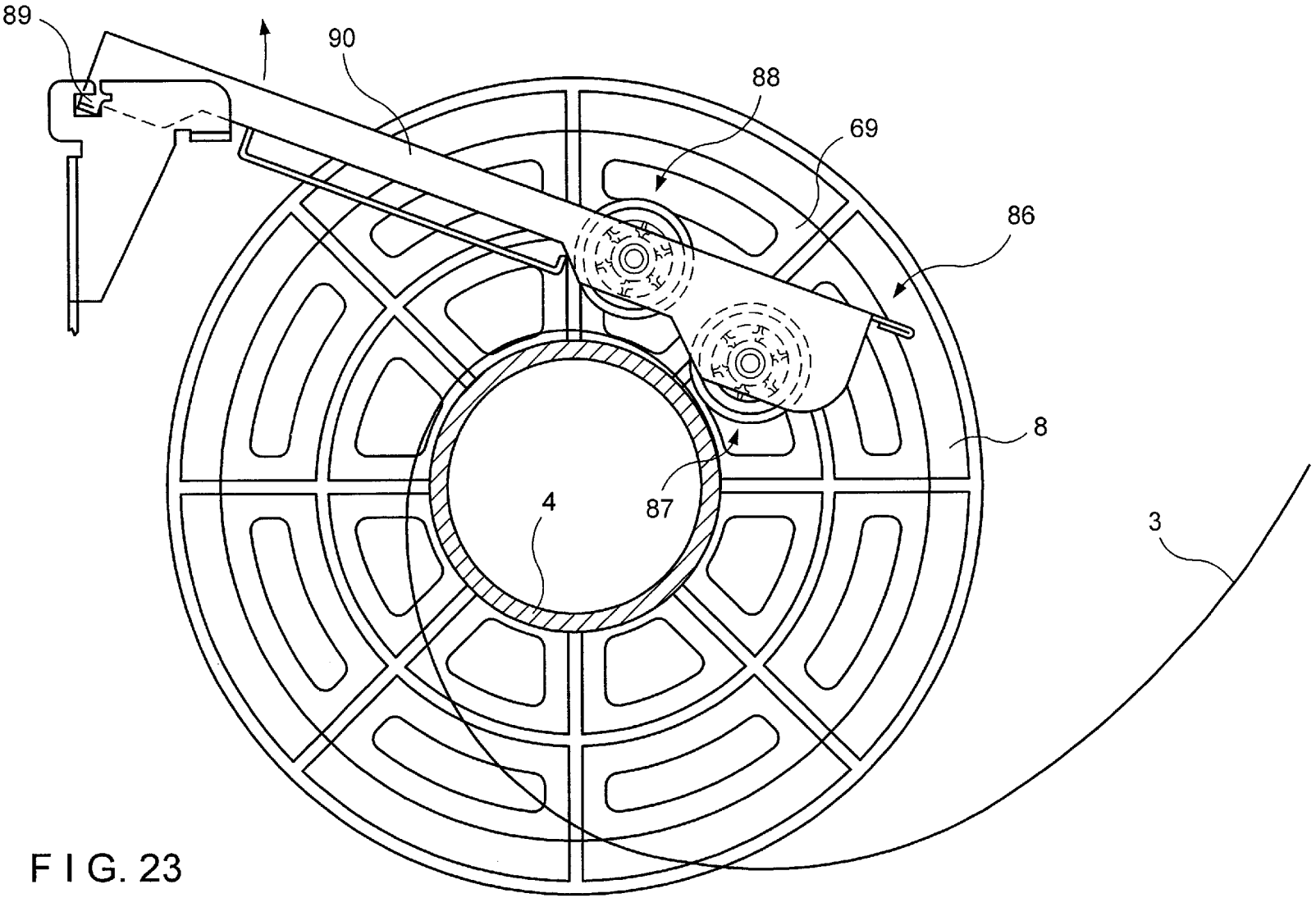
FIG. 23 is a side view of the condition under which the medium is wound correctly.

In this winding device 1, as illustrated in FIG. 22, a roller unit 86 is provided in the vicinity of each end of the core 4 to press the medium 3 tight while it is wound and to prevent the medium 3 from being wound crooked. Each of the roller units 86 consists of a primary roller 87 and a secondary roller 88. The primary roller 87 contacts the medium 3 during the winding of the medium 3 to give resistance (pressure) to the medium 3. The secondary roller 88 contacts the medium 3 individually or together with the primary roller 87 when the medium 3 is wounded obliquely and runs over the core holding mechanisms 8 and 32, so that a larger resistance than that only by the primary roller 87 is given. When the medium 3 is wound straight as shown by the single-dotted line in FIG. 22, the medium 3 is given resistance only by the primary roller 87 in each roller unit 86 as illustrated in FIG. 23, and thus the same resistance is given to both right and left sides of the medium 3. Consequently the medium 3 is lightly pressed and wound up, so that even a medium 3 that cannot tear easily can be tightly wound up.

Figure 24:
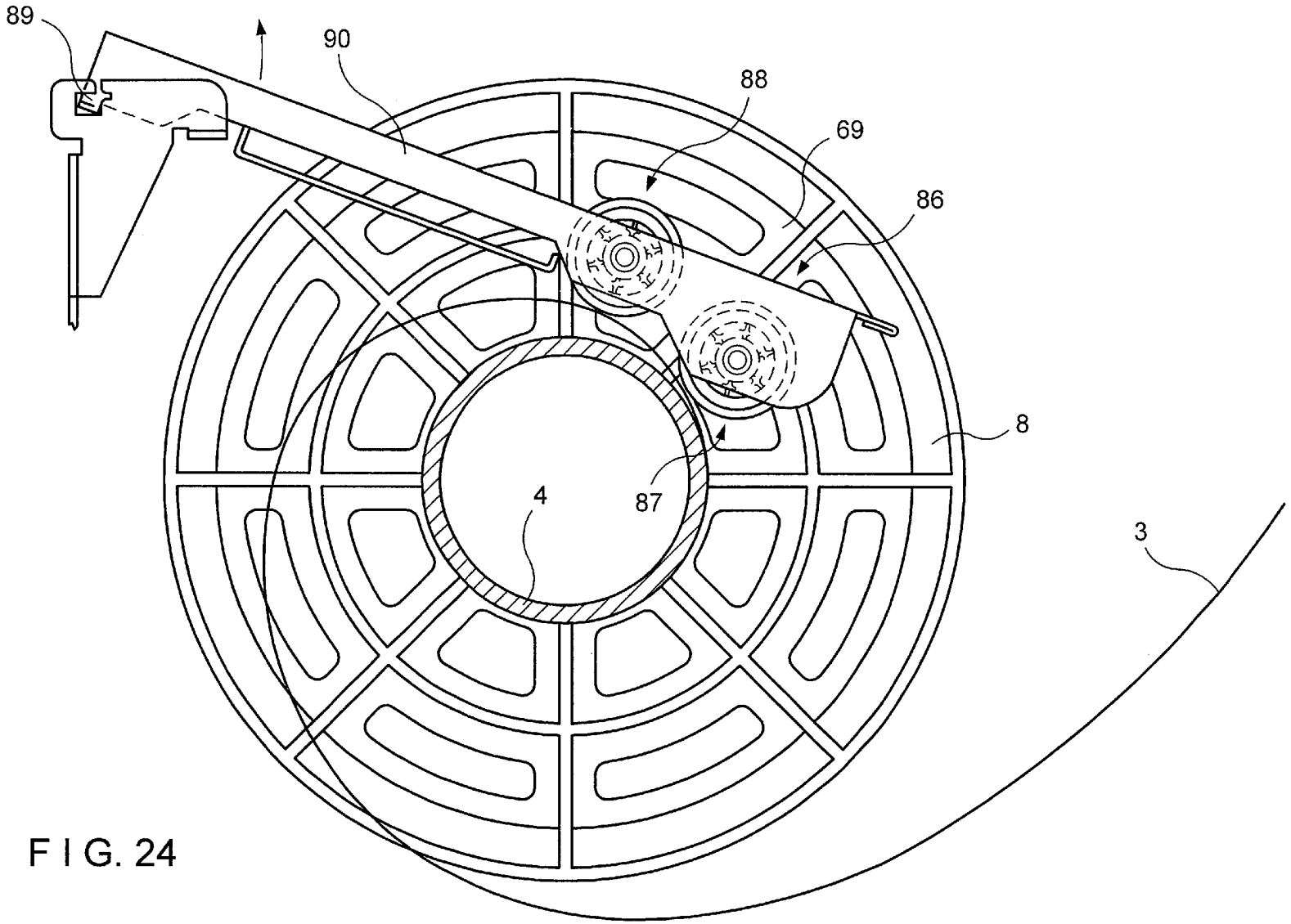
FIG. 24 is a side view of the condition under which the medium wanders off and runs over a flange.

When the medium 3 wanders off and one side edge thereof runs over one of the core holding mechanisms (here, the sliding-side core holding mechanism 32) as shown by the double-dotted line in FIG. 22, the resistance is given to the medium 3 by the secondary roller 88 only or together with the primary roller 87 in the roller unit 86 close to the core holding mechanism 32, over which the medium 3 has run, as illustrated in FIG. 24. On the other hand, the other roller unit 86 on the other end is given a resistance only by the primary 87 because the medium 3 does not expand. For this reason, the winding continues as the expanding side of the medium 3 is given a large resistance while the non-expanding side of the medium 3 is given a small resistance. As a result, the medium 3 is corrected from the oblique winding direction, to the opposite direction of wandering-off. Thus the direction of the oblique winding of the medium 3 is changed to correct the winding direction.

In addition to the primary and secondary rollers 87 and 88, each roller unit 86 further includes a bracket 90, which is mounted capable of swinging up and down with respect to the stay 11 with the work of a hinge 89 and supports the primary and secondary rollers 87 and 88. The bracket 90 switches the contact conditions of the rollers from one under which at least one of the rollers 87, 88 contacts the medium 3 to the other under which none of the rollers 87, 88 contact the medium 3 as the bracket 90 is lifted to the back.

Figure 25:
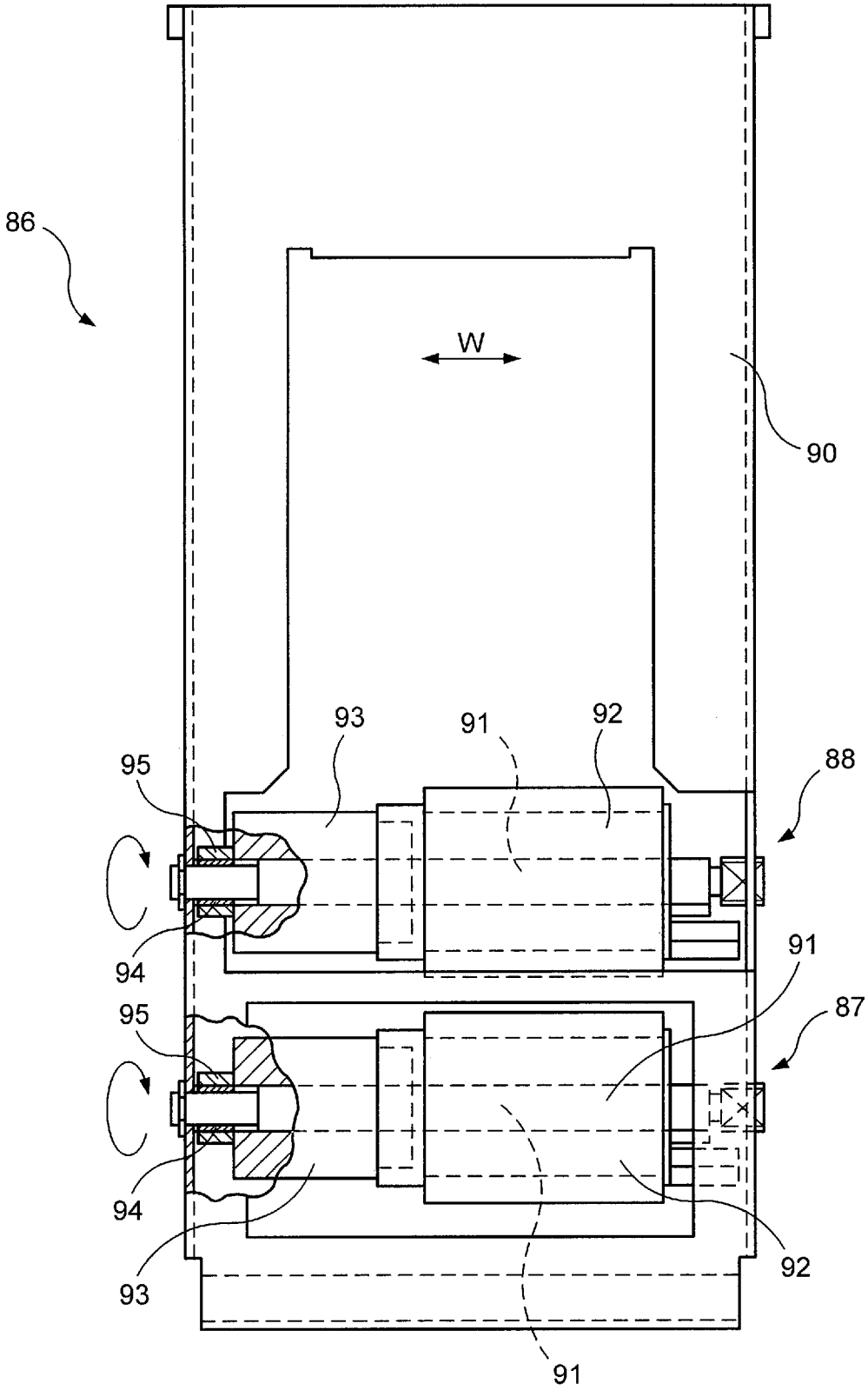
FIG. 25 is a plan view of roller units.
Figure 26:
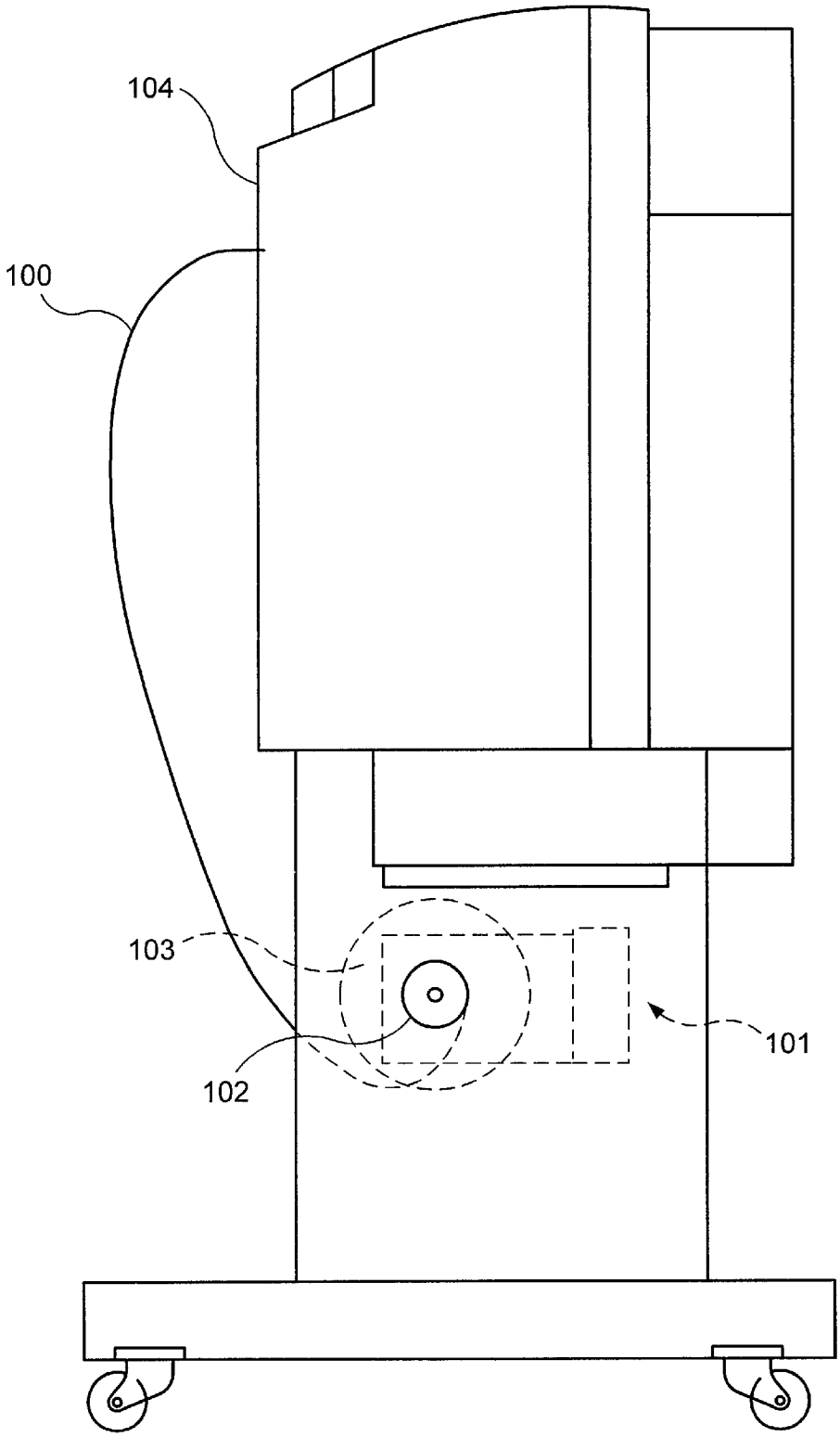
F I G. 26 PRIOR ART
FIG. 26 is a side view of a conventional winding device.
Figure 27:
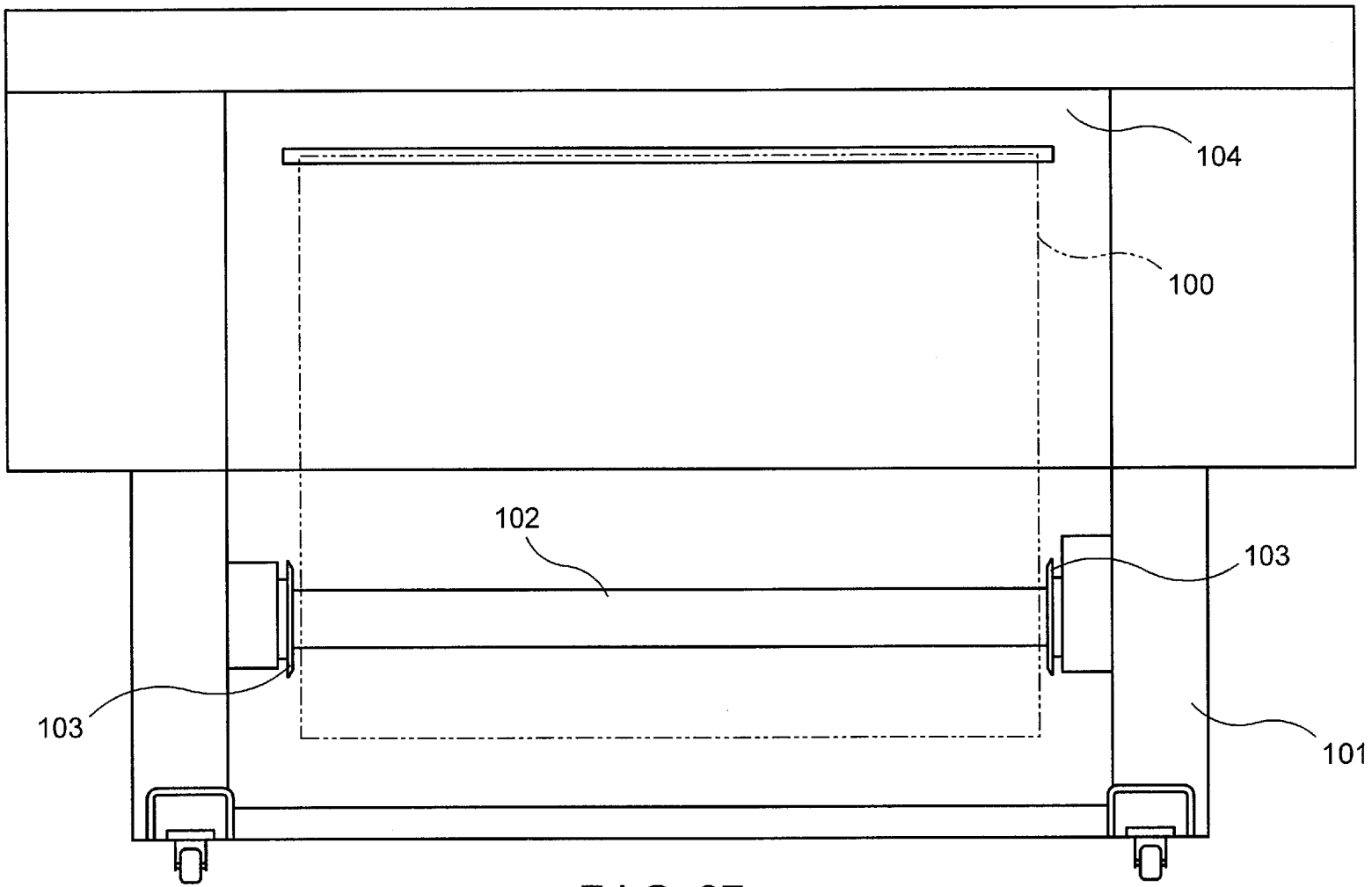
FIG. 27 PRIOR ART
FIG. 27 is a front view of the conventional winding device.
Figure 28:
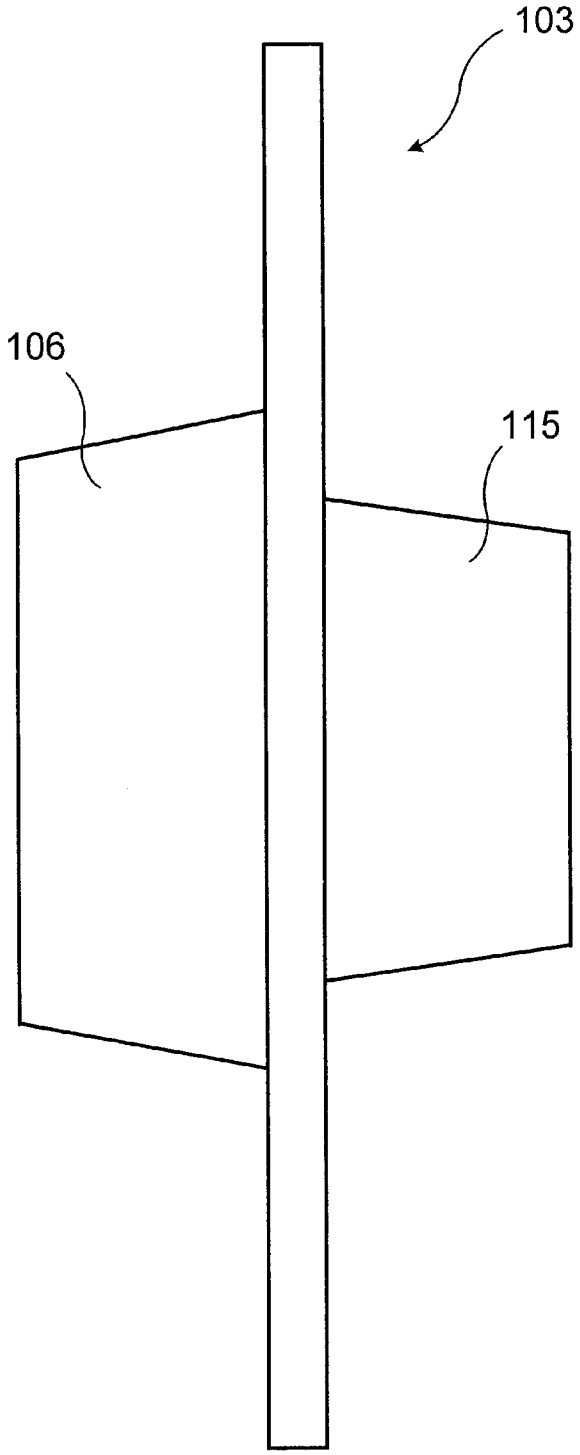
F I G. 28 PRIOR ART
FIG. 28 is a side view of a conventional winding core holding member.

As illustrated in FIG. 25, each of the rollers 87 and 88 consists of a support shaft 91 which is fixed to the bracket 90 to be incapable of rotating and extends along the width direction W, a rubber roller 92, a torque limiter 93, a one-way clutch spring 94, and a spacer 95 which is mounted onto the support shaft 91 in this order. The torque limiter 93 is of a double-layered cylindrical shape and the outer portion thereof is capable of rotating in one direction around the inner portion with a certain force, but is incapable of rotating in the opposite direction. A publicly-known torque limiter can be used. The outer portion of the torque limtter 93 is engaged with the rubber roller 92 to rotate together with the roller 92.

The one-way clutch spring 92 is provided between the inner portion of the torque limiter 93 and the support shaft 91. As rotated in the winding-up direction (shown by arrow in FIG. 25), the one-way clutch spring 94 is wound up tightly and united with the support shaft 91. With this, when the rubber roller 92 rolls touching the medium 3 in the winding direction, the rubber roller 92 and the outer portion of the torque limiter 93 rotate, but the inner portion of the torque limiter 93 does not rotate because the inner portion is fixed to the support shaft 91 by the one-way clutch spring 94. For this reason, a force is exerted as a brake by the torque limiter 93. The strength of the brake force depends on the torque value of the limiter 93.

When the rubber roller 92 is rotated in the direction opposite to the winding direction to pull out the wound-up medium 3, the outer portion and inner portion of the torque limiter 93 are rotated together; since this pulling-out direction is the same direction to which the one-way clutch spring 94 winds and spreads, the outer and inner portions of the limiter 93 rotate around the supporting shaft 91. Consequently the rubber roller 92, torque limiter 93, and one-way clutch spring 94 rotate altogether around the support shaft 91. In other words, the torque limiter 93 does not generate the braking force.

As illustrated in FIGS. 23 and 24, two of rollers 87 and 88 are arranged with a difference in level. Because of this, when the medium 3 is wound without touching the flange 69, only the primary roller 87 contacts the medium 3 as illustrated in FIG. 23; when the medium 3 runs over the flange 69, only the secondary roller 88 contacts the medium 3 as illustrated in FIG. 24.

The operation of the above mentioned winding device 1 to wind the medium 3 on the core 4 will be described hereinafter.

To wind the medium 3 on the core 4 continually, the sheet tray 7 is not attached. The core 4 is mounted to the roll medium holding device 44. At that time, an end portion of the core 4 is first attached to the fixed-side core holding mechanism 8, then the sliding-side core holding mechanism 32 is slid until it hits against the end faces 4*a* and 4*b* of the core 4, and finally the core 4 is sandwiched between the core holding mechanisms 8 and 32. Thus, the core 4 is kept held unless the operation lever is operated. Because the core 4 is held by the core holding mechanisms 8 and 32, the alignment of the end faces 4*a* and 4*b* of the core 4 with the reference position can be automatically performed no matter which size the core is.

After the core 4 is mounted, the output by the printer 2 is started. As the front end of the medium 3 reaches the core 4 with extra length, it is attached to the core 4 with a scotch-type tape. Even after this, the printer 2 continues output.

As the printer 2 continues printing out the medium 3, the medium 3 becomes very loose. The detecting sensor 6 detects the looseness of the medium 3. With this, the driving portion 9 is actuated so that both core holding mechanisms 8 and 32 and the core 4 are rotated together to start winding the medium 3. While the medium 3 is being wound, the printer 2 still keeps printing out the medium 3. However, since the speed of winding the medium 3 is faster than the output speed of the printer 2, the looseness of the medium 3 decreases, and finally the detecting sensor 6 no longer detects the looseness. At this point, the operation of the driving portion 9 is stopped to stop winding the medium 3.

As the medium 3 becomes very loose, it is wound up; as the medium 3 is tensioned, the operation of winding-up is stopped. By repeating these operations, the medium 3 output by the printer 2 can be wound on the core 4 of the winding device 1. When wound, the medium 3 is pressed by the first rollers 87 on the left and right sides, resulting in a tight winding.

The medium 3 may wander off during winding, as shown by the double-dotted line in FIG. 22, due to a slightly crooked end portion of the medium 3 when attached with a scotch-type tape. If this happens, the side edge of the medium 3 comes into contact with the flange 69 and it traces a spread course as illustrated in FIG. 24. As the medium 3 becomes loose around the core 4, the secondary roller 88 comes into contact with the medium 3. At the same time, since the medium 3 goes away from the flange 69 on the other side, the winding on that side does not increase and the primary roller 87 is in contact with the medium 3.

For this reason, the brake forces are generated in different levels at the roller units 86 on the right and left sides. As the roller units keep generating brake forces of different levels, the right side of the medium 3, which is given a weaker brake force, has less pressure on winding than the left side of the medium 3 which is given a stronger brake force. Consequently the winding length of the medium is longer on the right side. Because of the difference in the winding lengths on the right and left sides of the medium 3, the oblique winding is eased or the direction of the oblique winding is turned over (corrected). Thus, the oblique winding can be prevented.

To remove the wound-up medium 3 from the winding device 1, the sliding-side core holding mechanism 32 of the winding device 1 is receded to the side. For this, while the operation lever 50 is being pushed toward the receding direction, the slider portion 34 is easily slid. Then, the heavy roll medium 3 can be dismounted easily and safely.

When the medium 3 output by the printer 2 is cut, the sheet tray 7 is attached and the looseness-detecting sensor 6 at the detecting position shown by a broken line in FIGS. 8 and 5 is receded to the back.

The above is operated in the following manner. First, the sensor arm 18 is pushed to the back by a finger and the like. Then, the sensor arm 18 is rotated to rotate the friction plate 20. At that time, the friction plate 20 functions to rotate the clutch gear 21. But, since the clutch gear 21 is meshed with the gear portion 15 of the fixed-side core holding mechanism 8, it does not rotate. For this reason, the friction plate 20 slips against the clutch gear 21. As a result, the entire sensor arm assembly 10 is rotated, and the looseness-detecting sensor 6 is caused to recede to the back. Otherwise, the fixed-side core holding mechanism 32 may be held by hand and turned to the opposite direction to the winding direction to cause the looseness-detecting sensor 6 to recede to the back in the same manner.

A portion of the sensor arm 18 abuts to the spool supporting plate 12 or spool reinforcing plate 13 and reaches the receding position as illustrated by the double-dotted line in FIGS. 9 and 5. Even under the condition in which the sensor arm assembly 10 is caused to recede furthest to the back, since the friction plate 20 and clutch gear 21 feel the friction resistance due to the force of the spring 22, they do not move from the positions thereof. The clutch gear 21 is engaged with a decelerating gear train of the motor mechanism 9 via the gear portion 15 of the fixed-side core holding mechanism 8 and the pinion 16 of the motor mechanism 9; therefore, the sensor arm assembly 10 never turns with the weight thereof. Consequently the sensor arm assembly 10 is held at the position where it was stopped by the friction resistance thereof with the friction plate 20.

For causing the looseness-detecting sensor 6 to recede to the back, the operation is not limited to the above manual operation, but the power of the motor mechanism 9 may be used. In this case, the motor mechanism 9 is driven to rotate the fixed-side core holding mechanism 8 in the opposite direction to the winding direction. With this, the clutch gear 21 is rotated counterclockwise in FIG. 4. Then, the friction plate 20 is exerted against the friction resistance counterclockwise by the clutch gear 21, and the entire sensor arm assembly 10 united with the friction plate 20 rotates and recedes to the back. It is understood that, even with this, the receded condition can be maintained.

When cutting, the output medium 3 is stopped to start winding with the winding device 1 again, the sheet tray 7 is removed and the looseness-detecting sensor 6 is pulled forward to the looseness-detecting position.

The above operation is performed in the following manner. First, the core 4 is set in the winding device 5. The front edge of the medium 3 output by the printer 2 is attached to the core 4 with a scotch-type tape. By manual operation or turning on a fast forward switch, the core holding mechanism 8 is rotated in the winding direction to wind the medium 3 on the core 4 by more than single turn. Then, the preparation for winding the medium is completed. In other words, by rotating the fixed-side core holding mechanism 8, the clutch gear 21 engaged with the gear portion 15 of the core holding mechanism 8 is rotated clockwise in FIG. 5. Then, the friction plate 20 is exerted the clockwise rubbing resistance by the clutch gear 21, and the entire sensor arm assembly 10 united with the friction plate 20 rotates to return to the front side in the looseness-detecting position. Also, a portion of the sensor arm 18 abuts the spool supporting plate 12 or spool reinforcing plate 13 so that the sensor arm assembly 10 is positioned at the looseness-detecting position. Thus, the looseness-detecting sensor 6 automatically returns to the detecting position upon the movement of winding the medium 3. The looseness-detecting sensor 6 always and for certain returns to the detecting position.

When the core holding mechanism 8 starts winding, the gear portion 15 of the fixed-side core holding mechanism 8 continually attempts to rotate the clutch gear 21, but the clutch gear 21 keeps slipping against the friction plate 20. Because of this, the sensor arm assembly 10 does not move from the looseness-detecting position.

Note that although the above described embodiment is an example of the preferred embodiments, the present invention is not limited to this, but can be modified within the scope of the invention.

For example, although the winding core holding mechanisms 8 and 32 and the roll medium holding device 33 are used in the winding device 1 in this embodiment, they may be mounted onto the medium supplying portion in the printer 2 to hold the blank roll medium 3 before printing. Even in this case, the operability is improved in changing the core 4 to another of different size, and the reference position for the medium 3 to be output can be easily aligned with the winding core holding mechanisms 8 and 32. Also, the roll medium 3 can be easily attached/detached.

As understood from the above description, according to the winding core holding mechanism described above, both winding cores of larger and smaller diameters can be supported without attachment and detachment thereof. This improves operability and eliminates the troublesome management of the components.

Further, the reference position for the winding core can be always the same position regardless of the size of the attached core. For this reason, when the winding core holding mechanisms are used in a printer or a winding device, the position of the medium output by the printer can be easily aligned with that of the winding core. This prevents an oblique winding of the medium. Also, the winding core having the same width as the medium to be output can be used.

Further, each reference portion supports the winding core by the end face, and each centering portion centers the core with the tapered surface thereof. Therefore, even if the inner diameter of the winding core is not uniform, the center of rotation is first centered, and then the winding core end face is always set at the reference position.

Since there is no need to use a winding core exclusively used for the winding purpose, the cost of the winding core as well as the management of the winding core can be eliminated According to the invention, the reference edges of the medium supplied by the printer can be easily aligned with the reference position on the winding side. This prevents the oblique winding of the medium.

As understood from the above description, according to one form of the described roll medium holding device, the operation of moving/locking of the winding core holding mechanism and the operation of unlocking/moving can be easily performed by a one-touch operation. This improves safe operability of detaching/attaching the roll medium to a great extent.

According to another form of the roll medium holding device, the locking means can be composed of a simple mechanism. Accordingly the cost of the roll medium holding device can be reduced.

According to yet another form of the roll medium holding mechanism, the operation of the unlocking means and the receding operation of the slider portion can be performed by a one-touch button operation. This further improves operability.

According to the winding device of the invention, the operability is improved for installing an empty winding core in the winding device and for removing the wound-up roll medium from the winding device.

While the foregoing description and drawings represent the present invention, it will be obvious to those skilled in the art that various changes may be made therein without departing from the true spirit and scope of the present invention.

What is claimed is:

1. A winding core holding mechanism for holding at least one end portion of a winding core on which a thin medium such as paper, film, or cloth is wound, comprising:

a base fixed in the axial direction of said winding core;

a larger diameter reference portion, which is capable of axially moving in and out of said base and abuts an end face of said winding core;

a tapered larger diameter centering portion, which is capable of axially moving in and out of said larger diameter reference portion and fits into a winding core of larger diameter;

a smaller diameter reference portion, which is capable of axially moving in and out of said base and abuts an end face of a winding core of smaller diameter; and a tapered smaller diameter centering portion, which is capable of axially moving in and out of said smaller diameter reference portion and fits into said winding core of smaller diameter;

wherein in order to hold said winding core of larger diameter, said larger diameter centering portion centers said winding core while falling into said larger diameter reference portion, and also said larger diameter reference portion falls into said base to position said end face at a predetermined reference position with respect to said base; in order to hold said winding core of smaller diameter, said smaller diameter centering portion centers said winding core while falling into the smaller diameter reference portion, and also said smaller diameter reference portion, said larger diameter reference portion, and said larger diameter centering portion fall into said base to position said end face at said reference position.

2. A winding device for winding a thin medium such as paper, film, or cloth output by a printer on a winding core, comprising said winding core holding mechanism of claim 1 for holding said winding core.

3. A roll medium holding device equipped with a winding core holding mechanism for holding one end of a winding core of a thin medium such as paper, film, and cloth wound in a roll, a slider portion fixed onto said winding core holding mechanism, and guiding portions for supporting said slider portion to be capable of sliding along the width direction of said medium, comprising:

locking means for locking said slider portion from sliding in the direction away from said winding core; and unlocking means for unlocking said locking means;

wherein said locking means has wedge-shaped facing planes formed between said slider portion and said guiding portions and a stopper member for locking relative movement between said slider portion and said guiding portions.

4. The roll medium holding device as set forth in claim 3, wherein the operational direction of said unlocking means is the receding direction of said slider portion.

5. A winding device that winds a thin medium such as paper, film, or cloth output by a printer, comprising said roll medium holding device of claim 3.

* * * * *